US009982902B2

(12) United States Patent
Hayashi et al.

(10) Patent No.: US 9,982,902 B2
(45) Date of Patent: May 29, 2018

(54) AIR CONDITIONER WITH ROTATING OUTLET HOUSING

(71) Applicant: FUJITSU GENERAL LIMITED, Kanagawa (JP)

(72) Inventors: Yusuke Hayashi, Kawasaki (JP); Kenji Haruyama, Kawasaki (JP); Syun Iwano, Kawasaki (JP)

(73) Assignee: FUJITSU GENERAL LIMITED, Kanagawa (JP)

( * ) Notice: Subject to any disclaimer, the term of this patent is extended or adjusted under 35 U.S.C. 154(b) by 381 days.

(21) Appl. No.: 14/654,843

(22) PCT Filed: Dec. 27, 2013

(86) PCT No.: PCT/JP2013/085043
§ 371 (c)(1),
(2) Date: Jun. 22, 2015

(87) PCT Pub. No.: WO2014/104273
PCT Pub. Date: Jul. 3, 2014

(65) Prior Publication Data

US 2015/0345809 A1 Dec. 3, 2015

(30) Foreign Application Priority Data

Dec. 28, 2012 (JP) ..... 2012-288416

(51) Int. Cl.
*F24H 3/02* (2006.01)
*F24F 7/007* (2006.01)
(Continued)

(52) U.S. Cl.
CPC ..... *F24F 7/007* (2013.01); *F24F 1/0011* (2013.01); *F24F 13/20* (2013.01)

(58) Field of Classification Search
CPC ..... F24F 7/007; F24F 13/20; F24F 1/0011
(Continued)

(56) References Cited

U.S. PATENT DOCUMENTS 2,235,500 A 3/1941 Kitchen
2,640,412 A 6/1953 Sweger
(Continued)

FOREIGN PATENT DOCUMENTS

CN 1536279 A 10/2004
CN 1573229 A 2/2005
(Continued)

OTHER PUBLICATIONS

Non-final Office Action issued in related U.S. Appl. No. 13/872,830, dated Jul. 8, 2015.
(Continued)

*Primary Examiner* — Claire Rojohn, III
(74) *Attorney, Agent, or Firm* — McDermott Will & Emery LLP

(57) ABSTRACT

An aspect of the present invention relates to an air conditioner which is provided with a structural body, a wind direction plate, and auxiliary housings. The structural body forms an air outlet that extends in a horizontal direction and blows out a cool or warm airflow which is generated by a heat exchanger on a downward-facing surface which is continuous downward from a front surface, and includes one pair of wall bodies which are fixed to be immovable with respect to the air outlet on both sides of the first air outlet. The wind direction plate is disposed in the air outlet and is supported by the structural body to be freely rotatable around a horizontal shaft line. The auxiliary housings are attached to an outer wall surface of the wall body to be freely rotatable around a horizontal shaft on both sides of the air outlet, and form an auxiliary air outlet which blows out
(Continued)

taken-in indoor air. Furthermore, a distance L1 from an imaginary shaft line to the auxiliary air outlet is set to be longer than a distance L3 from the imaginary shaft line to the air outlet of the structural body.

4 Claims, 14 Drawing Sheets

(51) Int. Cl.
*F24F 13/20* (2006.01)
*F24F 1/00* (2011.01)
(58) Field of Classification Search
USPC ..... 165/121
See application file for complete search history.

(56) References Cited

U.S. PATENT DOCUMENTS 2,977,870 A 4/1961 Bierwirth et al.
2,999,370 A 9/1961 Eberhart
4,326,452 A * 4/1982 Nawa ..... F15D 1/08 137/829
4,537,035 A * 8/1985 Stiles ..... F24F 1/022 165/250
5,014,610 A 5/1991 Twito
5,242,325 A * 9/1993 Nukushina ..... F24F 1/0011 454/285
5,251,814 A 10/1993 Warashina et al.
5,467,606 A 11/1995 Sasaki et al.
5,547,018 A 8/1996 Takahashi et al.
6,283,380 B1 9/2001 Nakanishi et al.
6,338,382 B1 * 1/2002 Takahashi ..... F24F 1/0007 165/119
9,074,780 B2 * 7/2015 Lee ..... F24F 1/0059
9,250,028 B2 2/2016 Taira et al.
9,726,384 B2 * 8/2017 Taira ..... F24F 1/0059
9,863,661 B2 * 1/2018 Iwano ..... F24F 11/79
2004/0007002 A1 * 1/2004 Asami ..... F24F 1/0011 62/186
2004/0047743 A1 * 3/2004 Dooley ..... F04D 25/08 417/234
2005/0279120 A1 12/2005 Lee et al.
2005/0284170 A1 12/2005 Lee et al.
2007/0261425 A1 * 11/2007 Yasutomi ..... F24F 1/0007 62/263
2008/0242212 A1 10/2008 El-Galley et al.
2008/0242214 A1 10/2008 Sung
2009/0107167 A1 * 4/2009 Kim ..... F24F 1/0014 62/426
2009/0114377 A1 5/2009 Iheng et al.
2009/0183521 A1 * 7/2009 Shibuya ..... F24F 1/0007 62/259.1
2010/0015905 A1 * 1/2010 Hu ..... F24F 7/007 454/258
2010/0126206 A1 * 5/2010 Park ..... F24F 1/0007 62/419
2010/0132393 A1 6/2010 Kim et al.
2010/0168923 A1 7/2010 Park et al.
2011/0039491 A1 2/2011 Khalifa et al.
2011/0048050 A1 * 3/2011 Moteki ..... F24F 1/0007 62/263
2012/0031983 A1 2/2012 Shirota et al.
2012/0057973 A1 3/2012 Chen et al.
2012/0122389 A1 * 5/2012 Kishimoto ..... F24F 1/0007 454/284
2012/0135674 A1 * 5/2012 Uehara ..... F24F 1/0007 454/338
2012/0225618 A1 * 9/2012 Nouchi ..... F24F 1/0011 454/258
2012/0282117 A1 * 11/2012 Takahashi ..... F24F 7/007 417/65
2013/0167578 A1 7/2013 Ikeda et al.
2013/0255909 A1 * 10/2013 Matsumoto ..... F28F 27/00 165/11.1
2013/0284410 A1 * 10/2013 Taira ..... 165/121
2013/0284411 A1 10/2013 Taira et al.
2013/0284417 A1 10/2013 Taira et al.
2014/0041145 A1 * 2/2014 Matsumoto ..... A47L 9/2894 15/319
2014/0134939 A1 * 5/2014 Kamada ..... F24F 13/15 454/309
2014/0199936 A1 * 7/2014 Shang ..... F24F 13/10 454/307
2014/0227961 A1 * 8/2014 Yasutomi ..... F24F 13/14 454/325
2015/0129179 A1 * 5/2015 Moon ..... F25D 17/06 165/121
2015/0153063 A1 * 6/2015 Yasutomi ..... F24F 1/0011 454/241
2015/0338123 A1 11/2015 Iwano
2015/0354850 A1 12/2015 Iwano et al.
2015/0377242 A1 * 12/2015 Furuhashi ..... F24F 11/0078 415/148
2016/0033162 A1 * 2/2016 Hirakawa ..... F24F 13/20 165/237

FOREIGN PATENT DOCUMENTS

CN 202598794 U 12/2012
CN 103375848 A 10/2013
DE 102011112109 A1 3/2013
EP 1726889 A1 11/2006
EP 1813880 A1 8/2007
EP 2208946 A1 7/2010
EP 2416074 A2 2/2012
JP 55121342 9/1980
JP 5-69521 9/1993
JP 2000-297792 A 10/2000
JP 2002-022198 A 1/2002
JP 2002-130718 A 5/2002
JP 2003-130381 A 5/2003
JP 2004-286235 A 10/2004
JP 2008-281212 A 11/2008
JP 2010-164271 A 7/2010
JP 2011-069524 A 4/2011
JP 2012-078031 A 4/2012

OTHER PUBLICATIONS

Final Office Action issued in related U.S. Appl. No. 13/872,830, dated Dec. 24, 2015.
Non-final Office Action issued in related U.S. Appl. No. 13/872,875, dated Jun. 22, 2015.
Notice of Allowance issued in related U.S. Appl. No. 13/872,875, dated Oct. 2, 2015.
Non-final Office Action issued in related U.S. Appl. No. 13/872,816, dated Apr. 14, 2016.
International Search Report and Written Opinion, issued in International Patent Application No. PCT/JP2013/085043, dated Apr. 8, 2014; with English translation.
International Preliminary Report on Patentability issued in International Patent Application No. PCT/JP2013/085043, dated Jun. 30, 2015; with English translation.
International Search Report and Written Opinion, issued in International Patent Application No. PCT/JP2013/085044, dated Apr. 8, 2014; with English translation.
International Preliminary Report on Patentability issued in International Patent Application No. PCT/JP2013/085044, dated Jun. 30, 2015; with English translation.
International Search Report and Written Opinion, issued in International Patent Application No. PCT/JP2013/085045, dated Mar. 4, 2014; with English translation.
International Preliminary Report on Patentability issued in International Patent Application No. PCT/JP2013/085045, dated Jun. 30, 2015; with English translation.
Office Action issued in Japanese Patent Application No. 2012-103521, dated Jan. 20, 2016; with English translation.

(56) References Cited

OTHER PUBLICATIONS

Office Action issued in Japanese Patent Application No. 2012-103523, dated Mar. 16, 2016; with English translation.
Extended European Search Report EP 13 16 5503 dated Oct. 18, 2013.
Chinese Office Action dated Jan. 26, 2017 issued in Chinese Patent Application No. 201380067559.X (with English translation).

* cited by examiner

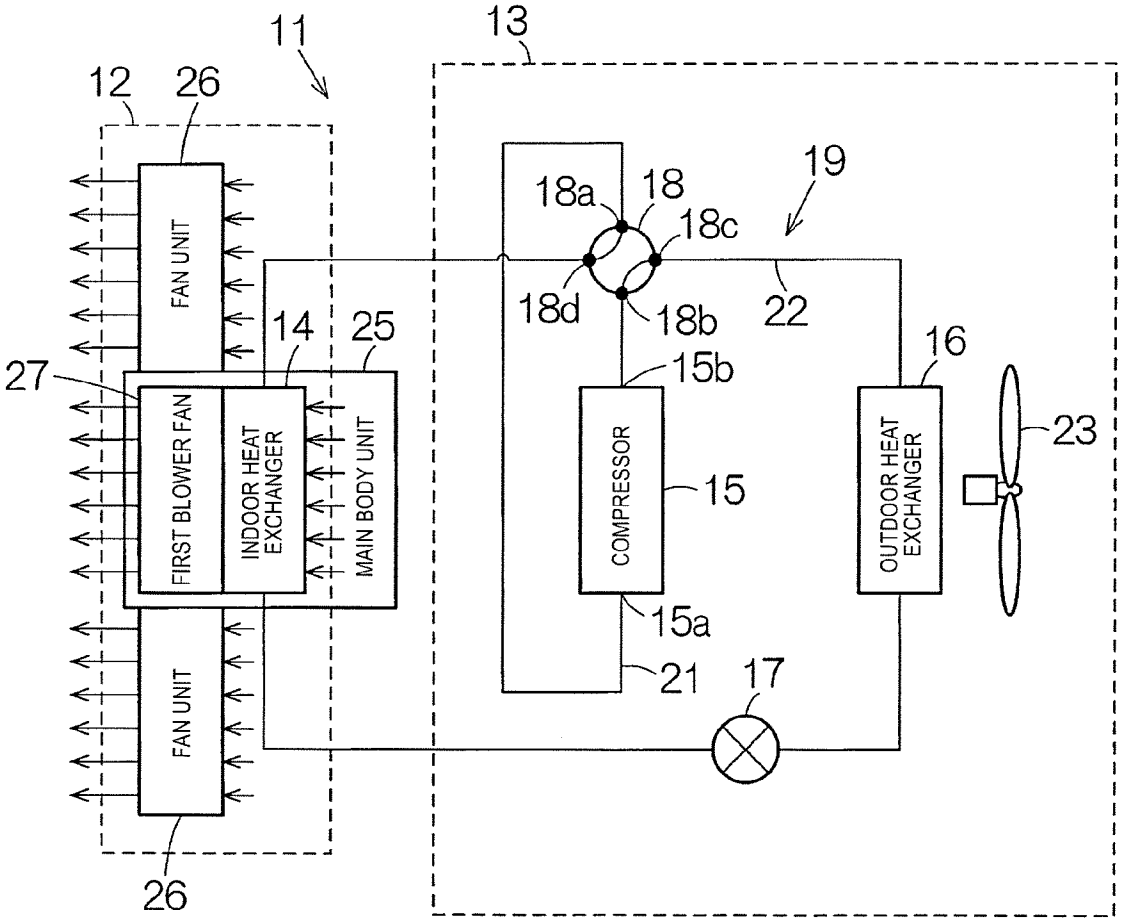
[FIG. 1]

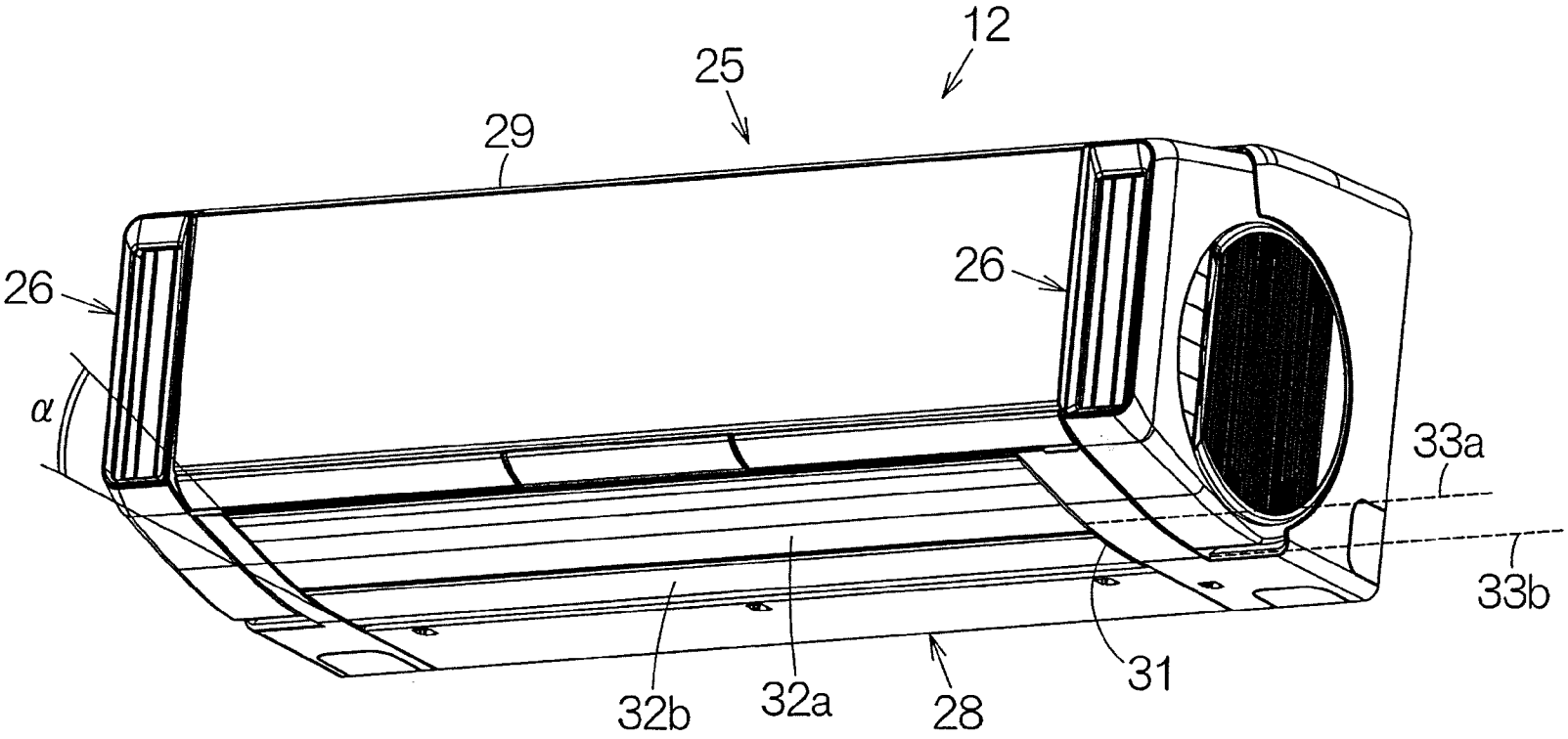
[FIG. 2]

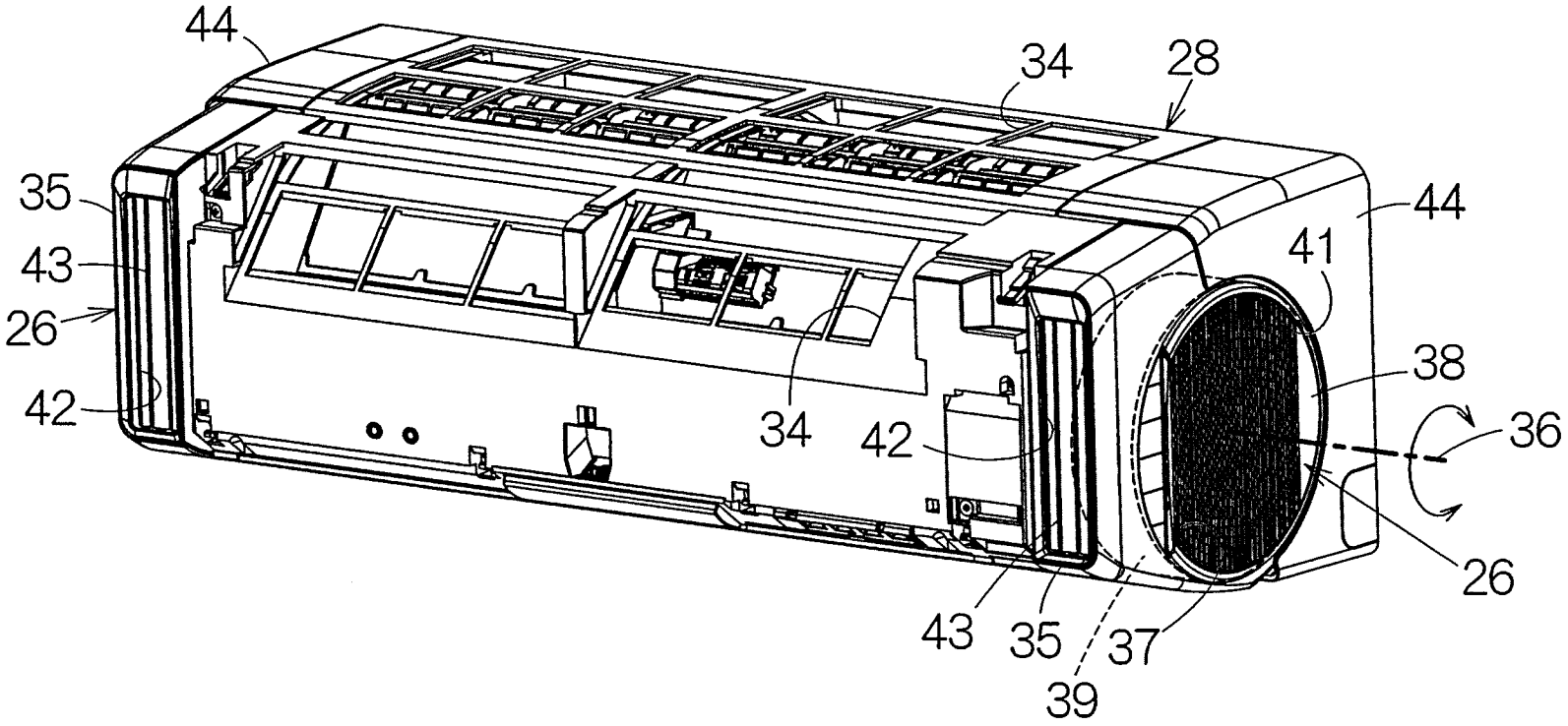
[FIG. 3]

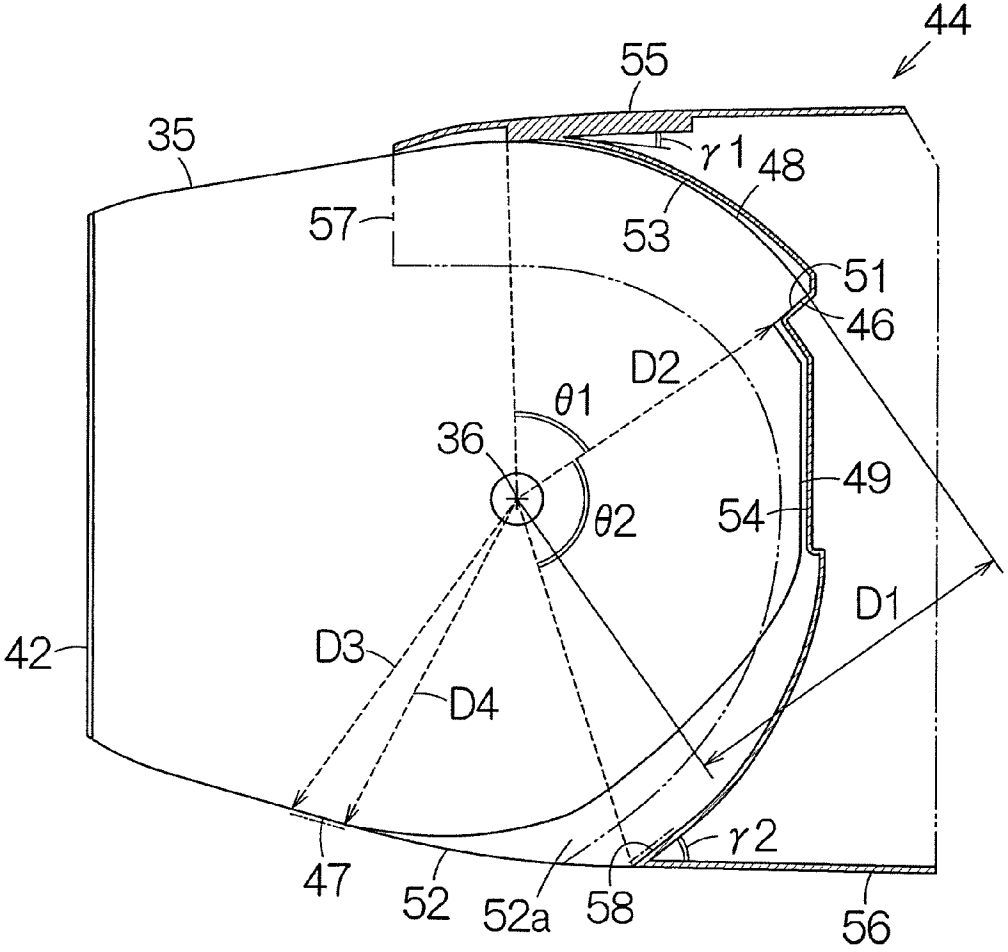
[FIG. 4]

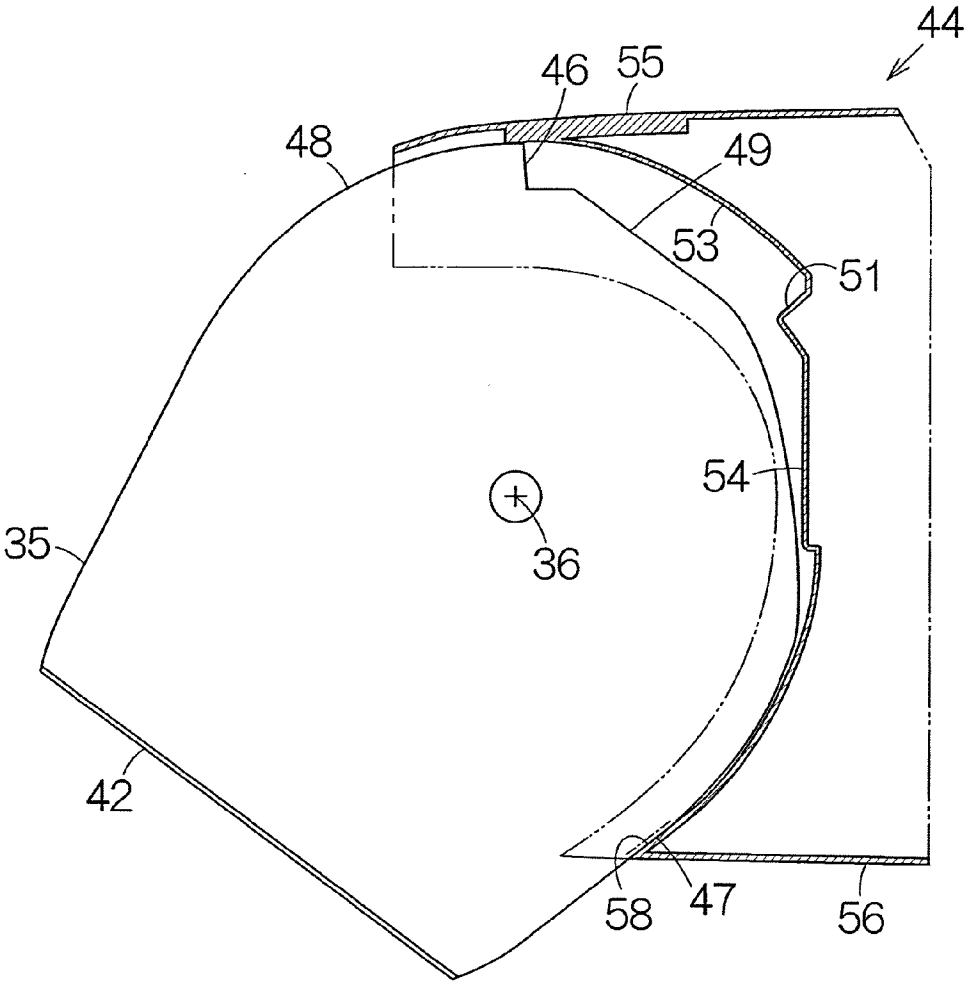
[FIG. 5]

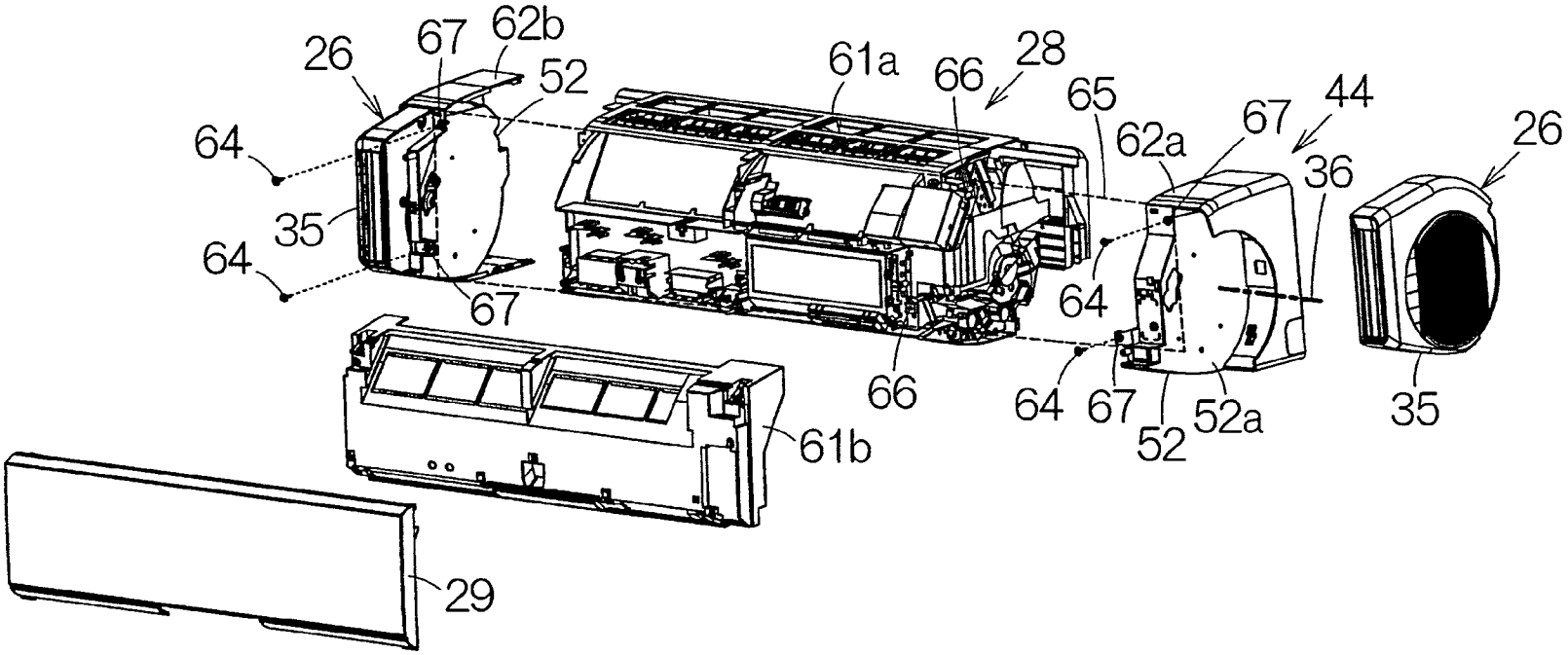
[FIG. 6]

[FIG. 7]
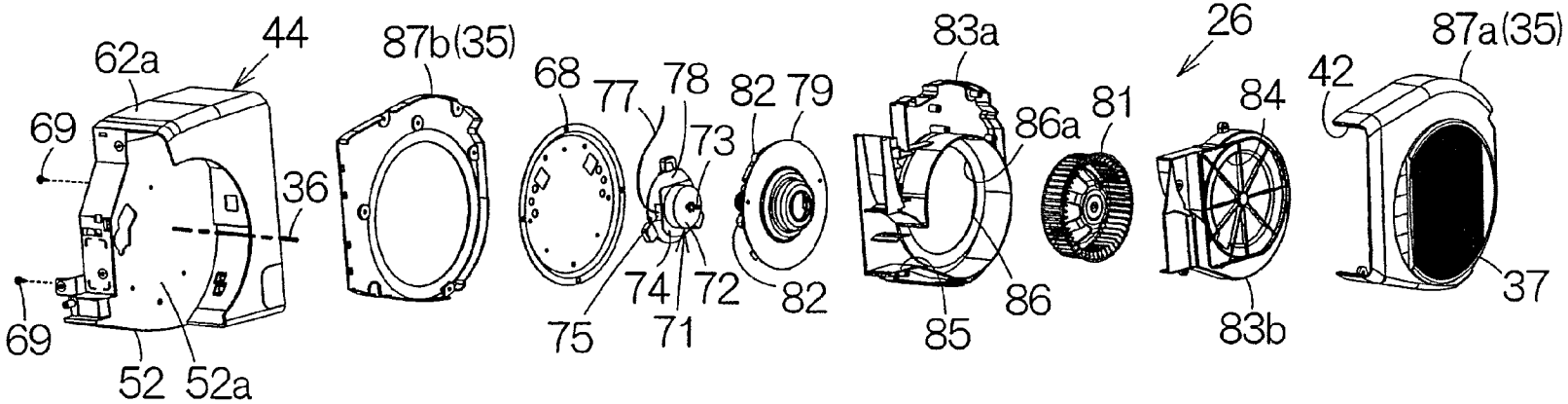

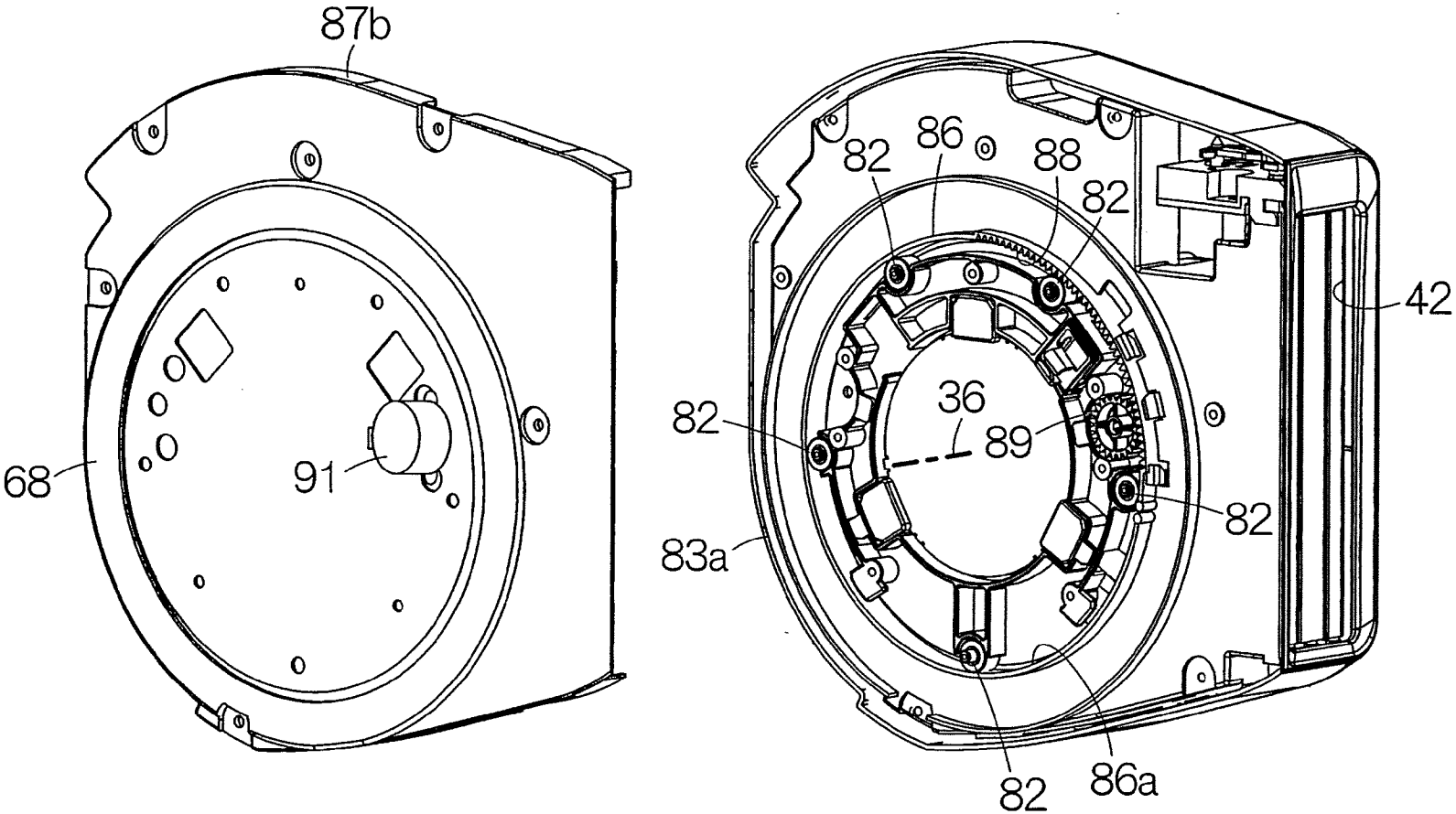
[FIG. 8]

[FIG. 9]
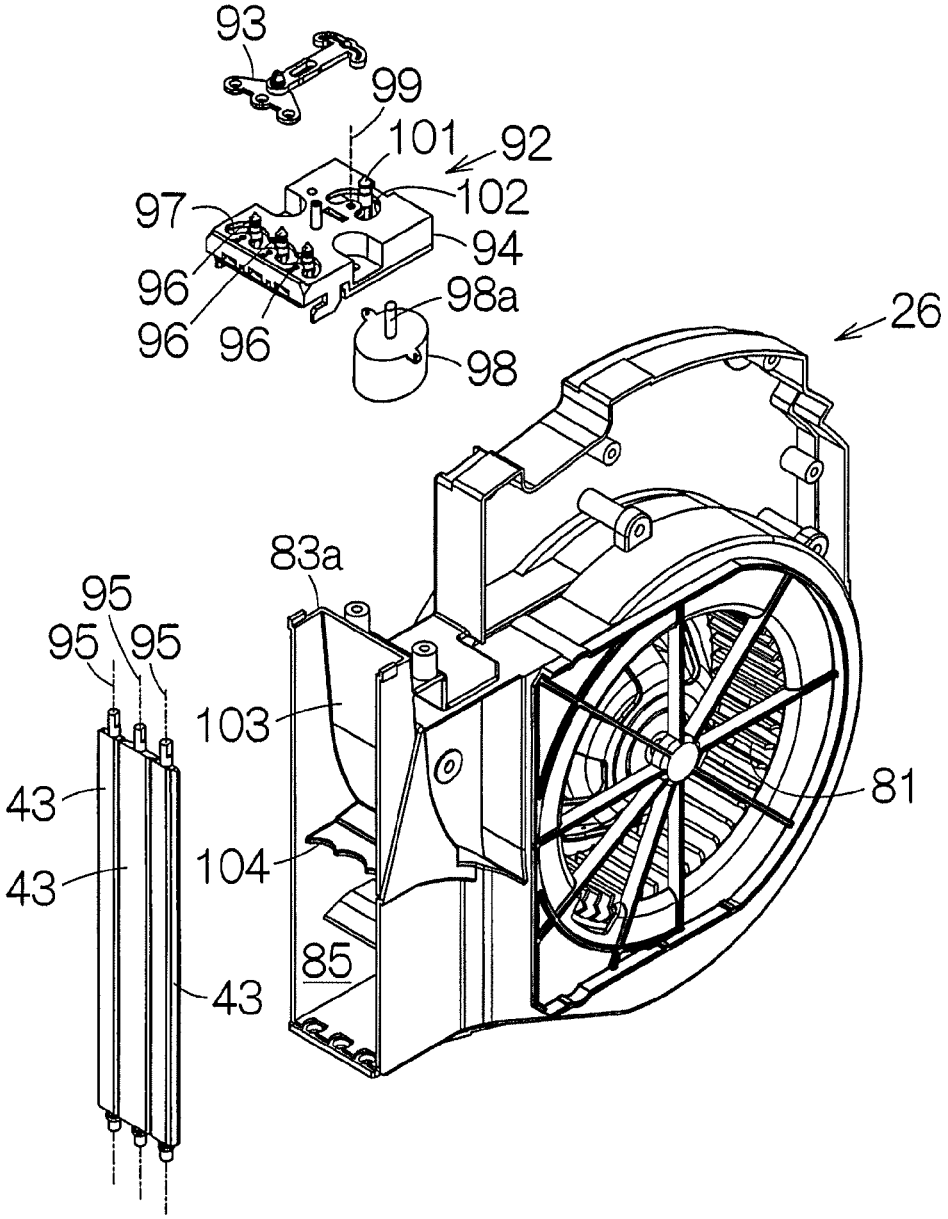

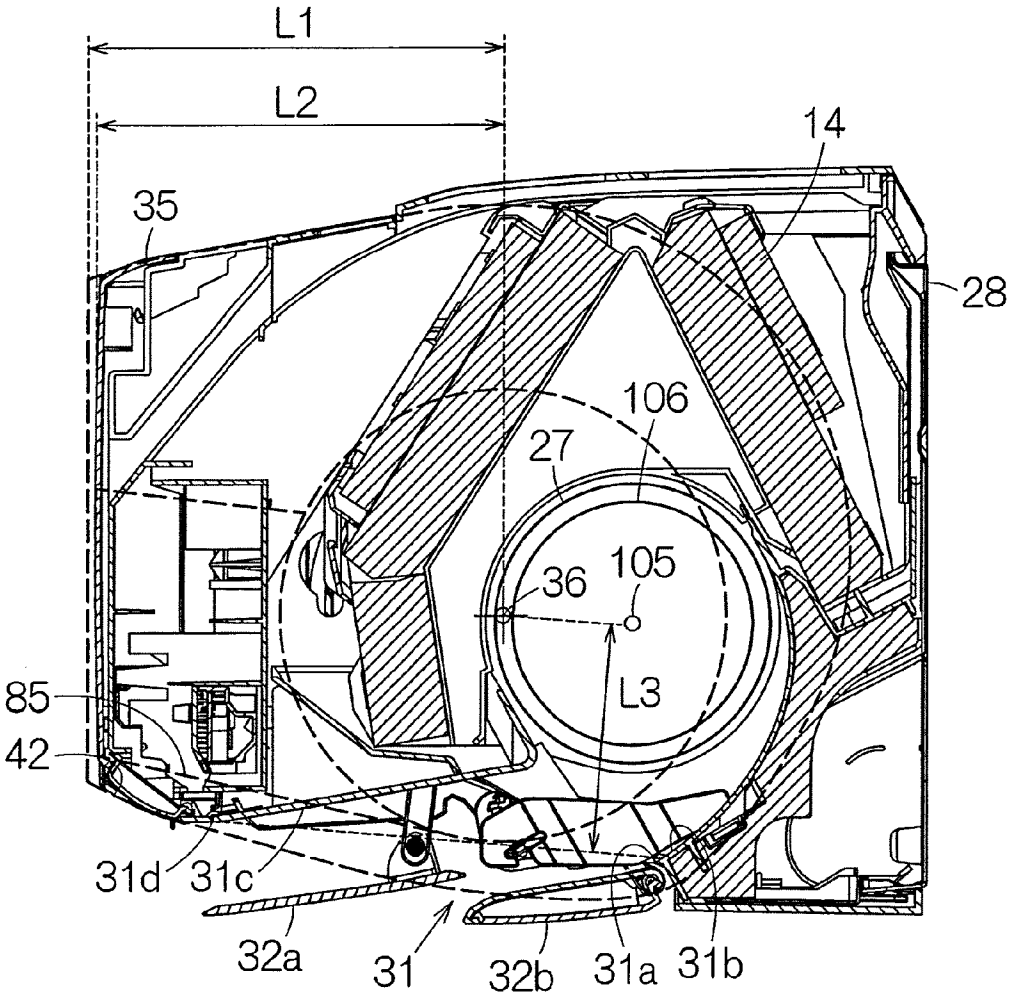
[FIG. 10]

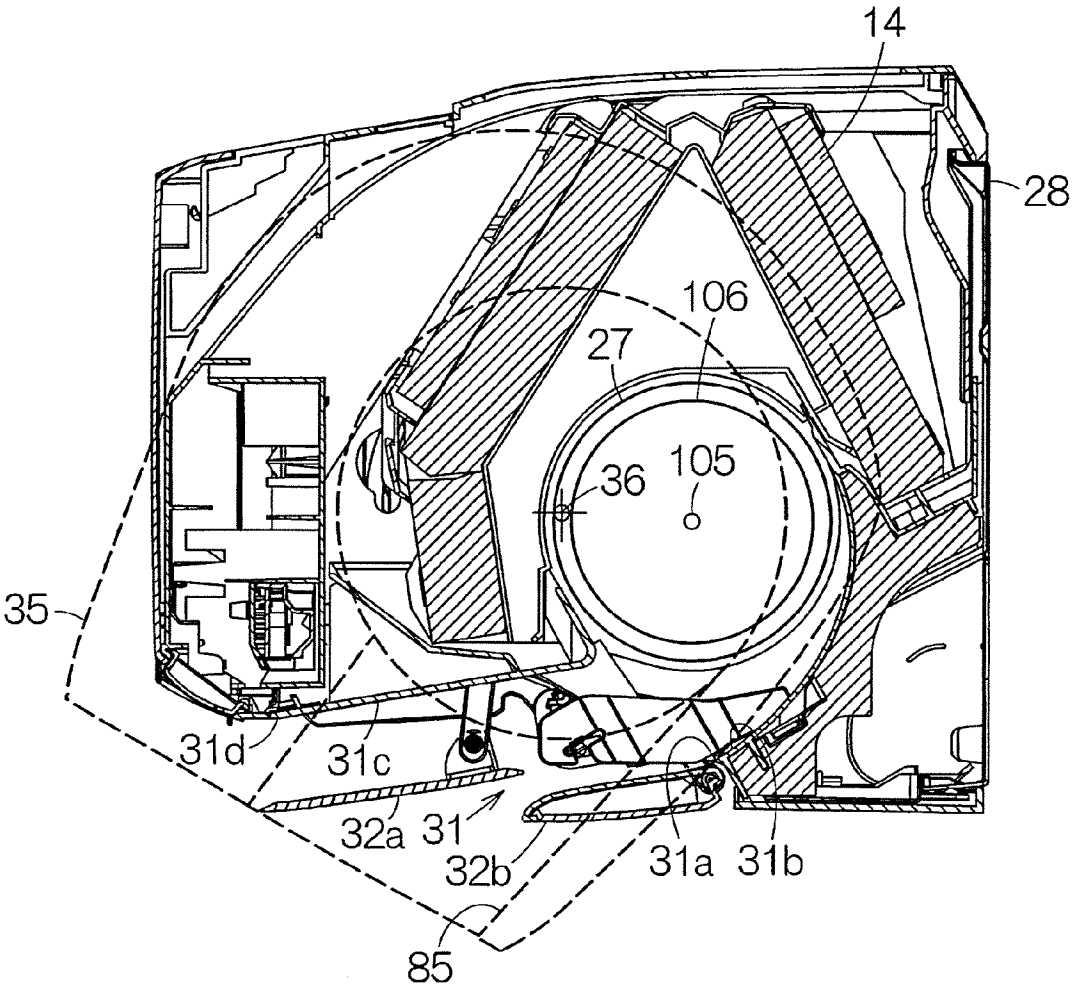
[FIG. 11]

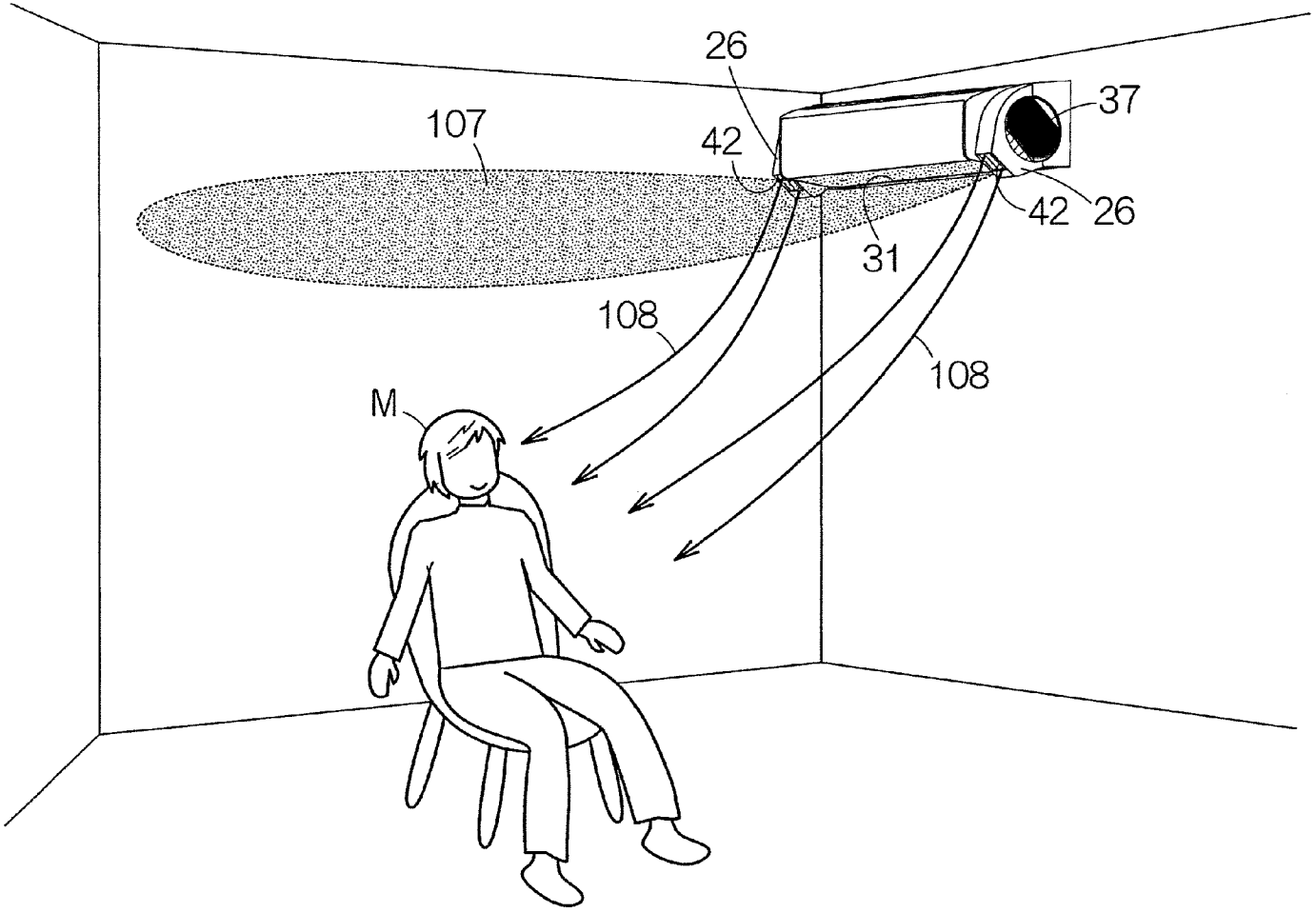
[FIG. 12]

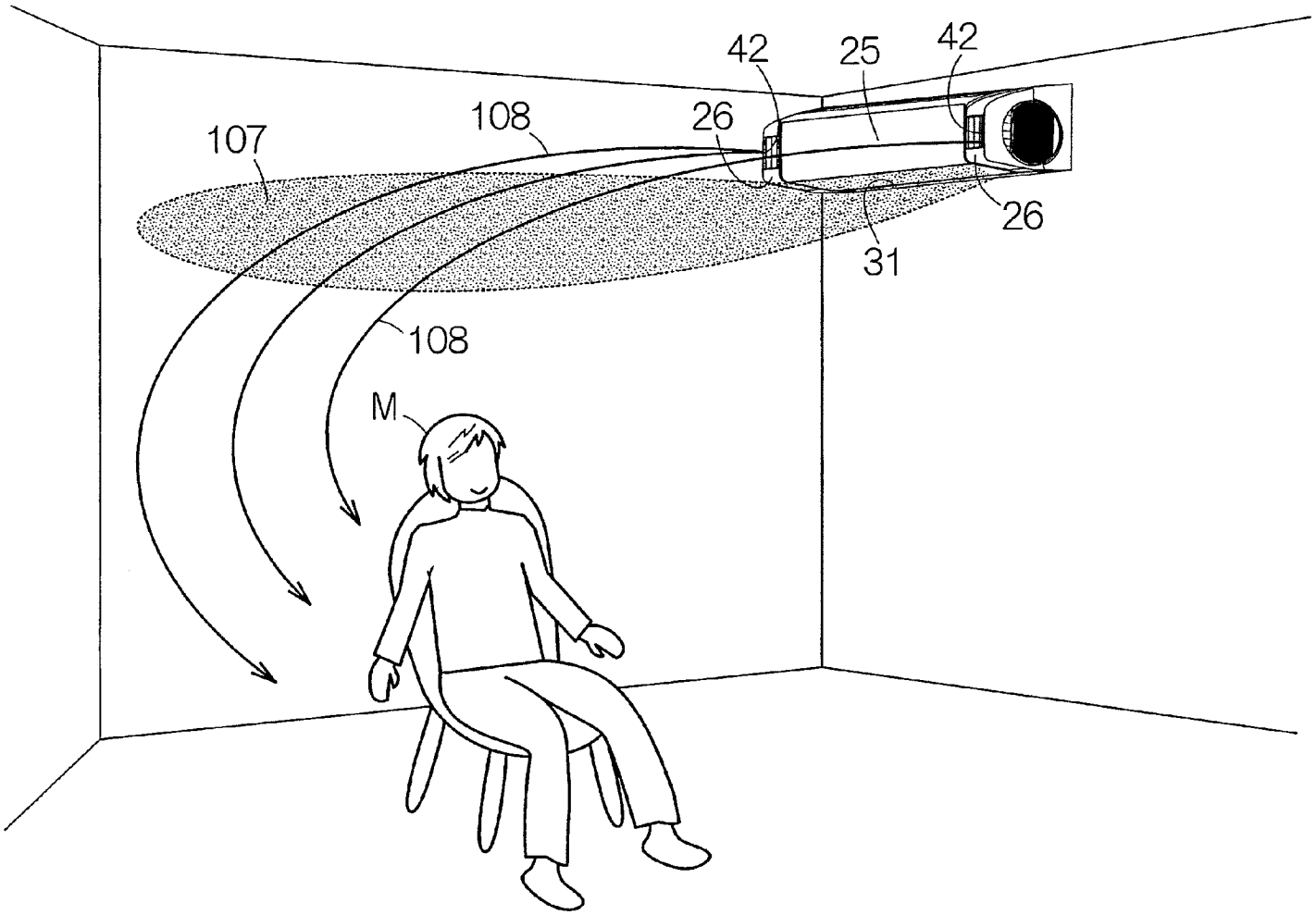
[FIG. 13]

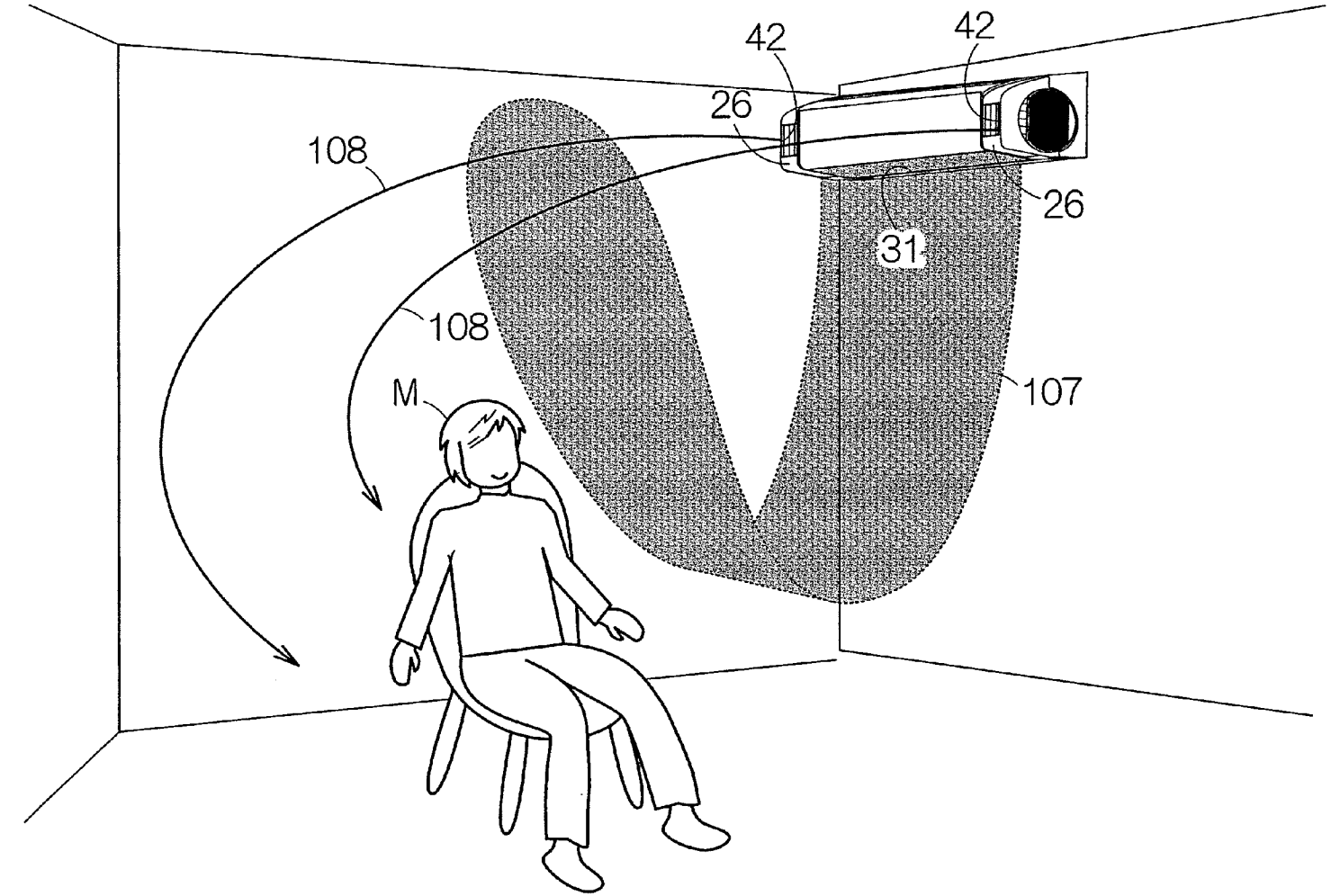
[FIG. 14]

AIR CONDITIONER WITH ROTATING OUTLET HOUSING

RELATED APPLICATIONS

This application is the U.S. National Phase under 35 U.S.C. § 371 of International Application No. PCT/JP2013/085043, filed on Dec. 27, 2013 which in turn claims the benefit of Japanese Patent Application No. 2012-288416 filed on Dec. 28, 2012, the disclosures of which the applications are incorporated by reference herein.

TECHNICAL FIELD

The present invention relates to an air conditioner.

BACKGROUND ART

An air conditioner blows out cool air or warm air that is heat-exchanged by a heat exchanger from an air outlet of an indoor unit. In PTL 1, auxiliary air outlets which are formed to be adjacent to both sides of the air outlet are disclosed. The auxiliary air outlets are open on a front surface of a housing. Upstream of the air outlet and the auxiliary air outlet, a dust collection filter is provided. It is possible for an airflow which passes though the dust collection filter to blow outward from the auxiliary air outlet. The airflow which passes through the dust collection filter is generated in a centrifugal fan. The centrifugal fan can allow the airflow to sufficiently pass through the dust collection filter having high air resistance. An orientation of the airflow is adjusted by a louver. The louver is attached to the air outlet and the auxiliary air outlet.

CITATION LIST

Patent Literature

PTL 1: JP-A-2010-164271
PTL 2: JP-A-2000-297792

SUMMARY OF INVENTION

Technical Problem

In general, in an air conditioner, a flow of indoor air influences an orientation or movement of the airflow, once it is blown out of an air outlet. If the orientation or the movement of this airflow can be finely controlled, a temperature environment which is more pleasant than before can be made in a room. The above-described related art does not disclose in which manner the airflow of the indoor air should be blown out of an auxiliary air outlet in order to make it possible to effectively control the orientation or the movement of the airflow without losing a force of the airflow.

According to several aspects of the present invention, it is possible to provide an air conditioner which can effectively maintain a force of the airflow even when the auxiliary air outlet is displaced in the air conditioner in which the auxiliary housings that enable a change in a posture are attached to both ends of a structural body.

Solution to Problem

An aspect of the present invention relates to an air conditioner which is provided with a structural body, a wind direction plate, and auxiliary housings. The structural body forms an air outlet that extends in a horizontal direction and blows out a cool or warm airflow which is generated by a heat exchanger on a downward-facing surface which is continuous downward from a front surface, and includes one pair of wall bodies which are fixed to be immovable with respect to the air outlet on both sides of the first air outlet. The wind direction plate is disposed in the air outlet and is supported by the structural body to be freely rotatable around a horizontal shaft line. The auxiliary housings are attached to an outer wall surface of the wall body to be freely rotatable around a horizontal shaft on both sides of the air outlet, and form an auxiliary air outlet which blows out taken-in indoor air. Furthermore, a distance L1 from the imaginary shaft line to the auxiliary air outlet is set to be longer than a distance L3 from the imaginary shaft line to the air outlet of the structural body.

In this air conditioner, the cool or warm airflow is blown out of the air outlet. The airflow of the indoor air is blown out of the auxiliary air outlet. There is a difference in temperature between the airflow of the indoor air which is blown out of the auxiliary air outlet and the cool or warm air which is generated by the heat exchanger and blown out of the air outlet. For this reason, it is possible to control an orientation or movement of the cool or warm airflow by the airflow of the indoor air. It is possible to send the cool or warm air to a desired indoor location. In this manner, it is possible to efficiently regulate the indoor temperature environment.

When the auxiliary air outlets are disposed on both sides of the downward-facing surface, the auxiliary air outlets are positioned below the air outlet. As a result, it is possible to avoid collision between the airflow of the indoor air and the cool or warm airflow. It is possible to effectively maintain a force of the airflow.

Here, when the auxiliary housings rotate and are disposed on both sides of the front surface of the structural body, it is possible to position the auxiliary air outlet in front of the front surface of the structural body. As a result, the indoor air can be blown out of the auxiliary air outlet without being disturbed by the structural body. The indoor air can accurately be blown out of the auxiliary air outlet to an upper side of an air layer of the airflow which is blown out of the air outlet.

The air conditioner can separately include: a first driving source which drives a first blower fan that is fixed to the structural body and generates the cool or warm airflow; and a second driving source which drives a second blower fan that is stored in the auxiliary housing and generates the airflow of the indoor air. A wind speed of the airflow of the indoor air can be set to be a wind speed which is different from a wind speed of the cool or warm airflow. An airflow having a high wind speed can control the orientation or the movement of the airflow having a lower wind speed. In this manner, it is possible to reliably control the orientation or the movement of the cool or warm airflow.

In the embodiment, regarding an air volume from the auxiliary air outlet and an air volume from the air outlet, the air volume from the air outlet is greater than the air volume from the auxiliary air outlet. The wind speed of the airflow which is blown out of the auxiliary air outlet is higher than the wind speed of the cool or warm airflow which is generated by the heat exchanger and blown out of the air outlet. Accordingly, it is possible to control a large amount of air by a small amount of air, and to make the inside of the room into a pleasant environment.

The second blower fan can be a centrifugal fan which rotates around a rotation shaft which overlaps with a rotation shaft of the auxiliary housing, and generates an airflow which is blown out of an auxiliary suction port. Since the rotation shaft of the centrifugal fan overlaps with the rotation shaft of the auxiliary housing, it is possible to constantly maintain a relative positional relationship between a moving trajectory of blades of the centrifugal fan and the auxiliary housing. Even when the auxiliary housing rotates, it is possible to constantly generate a constant airflow.

The air conditioner is provided with a blowing path which is partitioned in the auxiliary housing, and extends from below the centrifugal fan to the auxiliary air outlet. Without making an outline of the auxiliary housing protrude from an outline of the structural body, the auxiliary air outlets are disposed on both sides of the air outlet.

When the auxiliary housing rotates and the auxiliary air outlets are disposed on both sides of the front surface of the structural body, the auxiliary air outlet can be disposed to be further recessed than the front surface of the structural body. Even in a case where the air conditioner is set up while the front surface side of the structural body is oriented toward the floor surface when a positioning operation of the air conditioner is performed, the auxiliary air outlet is not in contact with the floor surface. Since a load is not applied to the auxiliary air outlet, there is no concern that the auxiliary housing is damaged.

Advantageous Effects of Invention

As disclosed above, according to the air conditioner, it is possible to provide an air conditioner which can effectively maintain the force of an airflow even when an auxiliary air outlet is displaced.

BRIEF DESCRIPTION OF DRAWINGS

FIG. 1 is a schematic view illustrating a configuration of an air conditioner according to an embodiment of the present invention.

FIG. 2 is a schematic perspective view illustrating an external appearance of an indoor unit according to the embodiment.

FIG. 3 is a schematic perspective view illustrating a configuration of a structural body.

FIG. 4 is a schematic partial perpendicular cross-sectional view illustrating a configuration of an auxiliary housing.

FIG. 5 is a schematic partial perpendicular cross-sectional view corresponding to FIG. 4 and illustrating a rotation operation of the auxiliary housing.

FIG. 6 is a schematic perspective view illustrating a structure of a first side panel and a second side panel.

FIG. 7 is an exploded perspective view of a fan unit.

FIG. 8 is a schematic perspective view of a blowing path unit illustrating a rack and a driving gear.

FIG. 9 is a schematic perspective view illustrating a configuration of a driving unit of a wind direction plate.

FIG. 10 is a schematic perpendicular cross-sectional view of the indoor unit illustrating a configuration of a first blower fan.

FIG. 11 is a schematic perpendicular cross-sectional view of the indoor unit illustrating a positional relationship between an auxiliary air outlet and an upper and lower wind plates.

FIG. 12 is a conceptual view illustrating a specific example of an airflow when a cooling operation is performed.

FIG. 13 is a conceptual view illustrating another specific example of the airflow when the cooling operation is performed.

FIG. 14 is a conceptual view illustrating a specific example of the airflow when a heating operation is performed.

DESCRIPTION OF EMBODIMENTS

Hereinafter, with reference to the attached drawings, an embodiment of the present invention will be described.

FIG. 1 is a schematic view illustrating a configuration of an air conditioner 11 according to an embodiment of the present invention. The air conditioner 11 is provided with an indoor unit 12 and an indoor unit 13. The indoor unit 12 is installed in an indoor space of a building, for example. Otherwise, the indoor unit 12 may be installed in an environmental space which corresponds to the indoor space. An indoor heat exchanger 14 is embedded in the indoor unit 12. In the indoor unit 13, a compressor 15, an outdoor heat exchanger 16, an expansion valve 17, and a four-way valve 18, are embedded. The indoor heat exchanger 14, the compressor 15, the outdoor heat exchanger 16, the expansion valve 17, and the four-way valve 18 form a refrigerant circuit 19.

The refrigeration circuit 19 is provided with a first circulating path 21. The first circulating path 21 links a first port 18*a* and a second port 18*b* of the four-way valve 18 to each other. In the first circulating path 21, the compressor 15 is provided. An inlet pipe 15*a* of the compressor 15 is connected to the first port 18*a* of the four-way valve 18 via refrigerant piping. A gas refrigerant from the first port 18*a* is supplied to the inlet pipe 15*a* of the compressor 15. The compressor 15 is compressed until pressure of a low-pressure gas refrigerant reaches a predetermined pressure. A discharge pipe 15*b* of the compressor 15 is connected to the second port 18*b* of the four-way valve 18 via the refrigerant piping. The gas refrigerant from the discharge pipe 15*b* of the compressor 15 is supplied to the second port 18*b* of the four-way valve 18. The first circulating path 21 is formed of the refrigerant piping, such as a copper tube.

The refrigerant circuit 19 is further provided with a second circulating path 22. The second circulating path 22 links a third port 18*c* and a fourth port 18*d* of the four-way valve 18 to each other. In the second circulating path 22, the outdoor heat exchanger 16, the expansion valve 17, and the indoor heat exchanger 14 are embedded in order from the third port 18*c* side. The outdoor heat exchanger 16 realizes exchange of heat energy between the passing-through refrigerant and ambient air. The indoor heat exchanger 14 realizes exchange of heat energy between the passing-through refrigerant and the ambient air. The second circulating path 22 may be formed of the refrigerant piping, such as a copper tube.

A blower fan 23 is embedded in the indoor unit 13. The blower fan 23 ventilates for the outdoor heat exchanger 16. The blower fan 23 generates an airflow in accordance with rotation of an impeller, for example. The airflow goes through the outdoor heat exchanger 16. Flux of the going-through airflow is adjusted in accordance with a rotating speed per minute of the impeller. In the outdoor heat exchanger 16, an amount of heat energy which is exchanged between a refrigerant and the air is adjusted in accordance with the flux of the airflow.

The indoor unit 12 is provided with a main body unit and one pair of fan units 26. The indoor heat exchanger 14 and a first blower fan 27 are embedded in the main body unit 25.

The first blower fan 27 is ventilated in the indoor heat exchanger 14. The first blower fan 27 generates the airflow in accordance with the rotation of the impeller. The indoor air is sucked in the main body unit 25 by the action of the first blower fan 27. The indoor air exchanges heat with the refrigerant which goes through the indoor heat exchanger 14. The heat-exchanged cool or warm airflow is blown out of the main body unit 25. Flux of the going-through airflow is adjusted in accordance with a rotating speed per minute of the impeller. It is possible to adjust an amount of heat energy which is exchanged between the refrigerant and the air by the indoor heat exchanger 14 in accordance with the flux of the airflow. The fan unit 26 sucks in the indoor air and blows out the indoor air.

When the cooling operation is performed by the refrigerant circuit 19, the four-way valve 18 connects the second port 18*b* and the third port 18*c* to each other, and connects the first port 18*a* and the fourth port 18*d* to each other. Therefore, the refrigerant having a high temperature and high pressure is supplied to the outdoor heat exchanger 16 from the discharge pipe 15*b* of the compressor 15. The refrigerant flows through the outdoor heat exchanger 16, the expansion valve 17, and the indoor heat exchanger 14 in order. Heat is radiated to outdoor air from the refrigerant by the outdoor heat exchanger 16. The pressure of the refrigerant is reduced until the pressure becomes low pressure by the expansion valve 17. The refrigerant of which the pressure is reduced absorbs heat from the ambient air by the indoor heat exchanger 14. Cool air is generated. The cool air flows in the indoor space in accordance with the action of the first blower fan 27.

When the heating operation is performed by the refrigerant circuit 19, the four-way valve 18 connects the second port 18*b* and the fourth port 18*d* to each other, and connects the first port 18*a* and the third port 18*c* to each other. The refrigerant having a high temperature and high pressure is supplied to the indoor heat exchanger 14 from the compressor 15. The refrigerant flows through the indoor heat exchanger 14, the expansion valve 17, and the outdoor heat exchanger 16 in order. Heat is radiated to the ambient air from the refrigerant by the indoor heat exchanger 14. Warm air is generated. The warm air flows in the indoor space in accordance with the action of the first blower fan 27. The pressure of the refrigerant is reduced until the pressure becomes low pressure by the expansion valve 17. The refrigerant of which the pressure is reduced absorbs the heat from the ambient air by the outdoor heat exchanger 16. After this, the refrigerant returns to the compressor 15.

FIG. 2 is a schematic view illustrating an external appearance of the indoor unit 12 according to the embodiment. The main body unit 25 of the indoor unit 12 is provided with a structural body 28. The structural body 28 is covered with an outer panel 29. An air outlet 31 is formed on a lower surface of the structural body 28. The air outlet 31 is open downward. The structural body 28 can be fixed to an indoor wall surface, for example. The air outlet 31 can be provided to extend in an orientation which is a horizontal direction when being installed, and the cool or warm airflow which is generated by the indoor heat exchanger 14 is blown out.

One pair of upper and lower wind direction plates 32*a* and 32*b* are disposed at front and rear parts in the air outlet 31. The upper and lower wind direction plates 32*a* and 32*b* can respectively rotate around horizontal shaft lines 33*a* and 33*b*. Rear ends of the upper and lower wind direction plates 32*a* and 32*b* become rotating shafts in the embodiment, but the invention is not limited thereto. The upper and lower wind direction plates 32*a* and 32*b* can open and close the air outlet 31 in accordance with the rotation.

As illustrated in FIG. 3, a suction port 34 is formed in the structural body 28. The suction port 34 is open on a front surface and an upper surface of the structural body 28. The outer panel 29 can cover the suction port 34 on the front surface of the structural body 28. The suction port 34 extends in the horizontal direction when being installed and takes in the airflow which flows in the indoor heat exchanger 14.

The fan units 26 are independently attached to both end sections of the main body which is made of an outer wall surface of the structural body 28 on both sides of the suction port 34 which extends in the horizontal direction and the air outlet 31. The fan unit 26 is disposed on an outer side of the outer wall surface of the structural body 28. The fan units 26 are respectively provided with an auxiliary housing 35. The auxiliary housing 35 is supported by the outer wall surface of the structural body 28 to be freely movable with respect to the structural body 28. Here, the auxiliary housing 35 can rotate around a rotation shaft which intersects the outer wall surface of the structural body 28. In the embodiment, a rotation shaft of the fan unit 26 is a horizontal shaft line 36. The horizontal shaft lines 33*a*, 33*b*, and 36 extend in parallel to each other. The outer wall surfaces of the structural body 28 widen in parallel to each other. Therefore, the outer wall surfaces which are provided on both end sections of the structural body 28 are orthogonal to the horizontal shaft lines 33*a*, 33*b*, and 36.

An auxiliary suction port 37 is formed in the auxiliary housing 35. The auxiliary suction port 37 takes in the indoor air in a perpendicular direction of the outer wall surface of the structural body 28. The auxiliary suction port 37 is covered with an auxiliary suction port cover 38. The auxiliary suction port cover 38 is attached to the auxiliary housing 35. An outline of the auxiliary suction port cover 38 is partitioned along an imaginary cylindrical surface 39 coaxially with the horizontal shaft line 36 on an inner side of the imaginary cylindrical surface 39. In other words, the auxiliary suction port cover 38 has a circular outline. A plurality of openings 41 are formed in the auxiliary suction port cover 38. The openings 41 connect inner and outer spaces of the auxiliary suction port 37 to each other.

An auxiliary air outlet 42 is formed in the auxiliary housing 35. The auxiliary air outlet 42 blows out the indoor air which is taken to the auxiliary housing 35 from the auxiliary suction port 37. The airflow from the auxiliary air outlet 42 is blown out in a direction along the outer wall surface. When the auxiliary housing 35 rotates around the horizontal shaft line 36, the auxiliary air outlet 42 can be vertically displaced in a direction of gravity. The orientation of the airflow which is blown out of the auxiliary air outlet 42 can be changed. Here, a forward direction side which follows an orientation of the rotation of the auxiliary housing 35 that makes the auxiliary air outlet 42 descend in the direction of gravity is referred to as "downstream", and a reverse direction side is referred to as "upstream". A wind direction plate 43 is attached to the auxiliary air outlet 42. The wind direction plate 43 can deflect an orientation of the airflow which is blown out of the auxiliary air outlet 42 in the horizontal direction.

In addition, a structure in which a posture of the auxiliary housing 35 is changed is not limited thereto. For example, a wind direction plate which changes the wind direction in the vertical direction may be provided in the auxiliary air outlet 42, a rear surface side of the auxiliary housing 35 may be supported by the outer wall surface of the structural body 28, and the orientation of the auxiliary air outlet 42 may be changed in the horizontal direction. In addition, a wind direction plate which changes the wind direction in a leftward and rightward direction may be provided in the auxiliary air outlet 42, and the auxiliary housing 35 may be vertically moved by a guide rail provided on the outer wall surface of the structural body 28.

The structural body 28 is provided with an auxiliary structural body 44. The auxiliary structural body 44 is formed on the outer wall surface on the periphery of the auxiliary housing 35. The auxiliary structural body 44 protrudes further outside from the wall surface than the auxiliary housing 35. An edge of the auxiliary structural body 44 is divided along the imaginary cylindrical surface 39 on the outer side of the above-described imaginary cylindrical surface 39.

As illustrated in FIG. 4, an outer edge of the auxiliary housing 35 forms a first stopper surface 46. The first stopper surface 46 is provided between an outer end of a first distance D1 from the horizontal shaft line 36 and an inner end of a second distance D2 which is shorter than the first distance D1. When the auxiliary housing 35 rotates and moves to upstream around the horizontal shaft line 36, the first stopper surface 46 is formed to abut against a regulating body 51 which will be described later. The first stopper surface 46 can be formed on a plane. The first stopper surface 46 may be included in the imaginary plane which includes the horizontal shaft line 36, and may be inclined at a predetermined inclination angle with respect to the imaginary plane.

The outer edge of the auxiliary housing 35 forms a second stopper surface 47. The second stopper surface 47 is provided between an outer end of a third distance D3 from the horizontal shaft line 36 and an inner end of a fourth distance D4 which is shorter than the third distance D3. When the auxiliary housing 35 rotates and moves to downstream around the horizontal shaft line 36, the second stopper surface 47 is formed to abut against an auxiliary regulating section 58 which will be described later. The second stopper surface 47 can be formed on a plane. The second stopper surface 47 may be included in the imaginary plane which includes the horizontal shaft line 36, and may be inclined at a predetermined inclination angle with respect to the imaginary plane.

The outer edge of the auxiliary housing 35 forms a first edge surface 48 and a second edge surface 49. The first edge surface 48 widens to downstream around the horizontal shaft line 36 from the outer end of the first stopper surface 46. The first edge surface 48 can be configured of a curved surface, for example. The curved surface can widen along a cylindrical surface having a radius which is the first distance D1 from the horizontal shaft line 36. The second edge surface 49 widens from an inner end of the first stopper surface 46 to an inner end of the second stopper surface 47. The second edge surface 49 can be configured of a curved surface, for example.

The auxiliary structural body 44 forms the regulating body 51. The regulating body 51 can be configured of a wall which rises from an outer wall surface 52*a* in the perpendicular direction with respect to the outer wall surfaces 52*a* of a wall bodies 52 that are provided in the structural body 28 and fixed to both sides of the air outlet 31. The regulating body 51 has a wall surface which faces downstream around the horizontal shaft line 36. The regulating body 51 is disposed on a moving path of the first stopper surface 46. When moving the auxiliary air outlet 42 upward through the rotation of the auxiliary housing 35, the first stopper surface 46 abuts against the regulating body 51. In this manner, when moving the auxiliary air outlet 42 upward through the rotation of the auxiliary housing 35, the regulating body 51 is positioned on a route of the first stopper surface 46 and regulates the rotation of the auxiliary housing 35. A position of the auxiliary housing 35 can be determined at a stop position, that is, a horizontal posture, in accordance with the regulation of the rotation. In this horizontal posture, the auxiliary air outlet 42 is oriented in the horizontal direction.

In the above-described horizontal posture, a lower surface of the wall body 52 and a lower surface of the auxiliary housing 35 are the same surface. Accordingly, in a case where a worker holds both sides of the air conditioner when an installation operation of the air conditioner is performed, it is easy to hold the air conditioner since a physical step is not provided. In addition, the regulating body 51 also has a function of stopping the rotation when the auxiliary housing 35 is rotated by a driving motor 91 which will be described later. Accordingly, when the auxiliary housing 35 is rotated upward by the driving motor 91, since the auxiliary housing 35 may not be provided with detecting means which detect whether or not the auxiliary housing 35 is in a horizontal posture, cost reduction can be achieved.

The auxiliary structural body 44 is provided with a first wall 53. The first wall 53 can be configured of a curved wall which has a constant thickness, for example. The first wall 53 rises from the outer wall surface 52*a* in the perpendicular direction with respect to the outer wall surface 52*a* of the wall body 52. In this manner, the first wall 53 protrudes further outside than the auxiliary housing 35. A wall surface of the first wall 53 has a bus in the perpendicular direction of the outer wall surface 52*a* in parallel to the horizontal shaft line 36. The first wall 53 widens along a moving trajectory which is drawn by the outer edge of the auxiliary housing 35, that is, the outer end of the first stopper surface 46, across a first center angle range θ1 around the horizontal shaft line 36 at a position of the first distance D1 from the horizontal shaft line 36. Here, the wall surface of the first wall 53 is provided to be curved so as not to come into contact with the first edge surface 48 when the auxiliary housing 35 rotates.

The auxiliary structural body 44 is provided with a second wall 54. The second wall 54 can be configured of a curved wall which has a constant thickness, for example. The second wall 54 rises from the outer wall surface 52*a* in the perpendicular direction with respect to the outer wall surface 52*a* of the wall body 52. In this manner, the second wall 54 protrudes further outside than the auxiliary housing 35. A wall surface of the second wall 54 has a bus in the perpendicular direction of the outer wall surface 52*a* in parallel to the horizontal shaft line 36. The second wall 54 widens along a moving trajectory which is drawn by the outer edge of the auxiliary housing 35, that is, the second edge surface 49, across a second center angle range θ2 which is positioned on the outer side of the first center angle range θ1 around the horizontal shaft line 36 at a position of the second distance D2 from the horizontal shaft line 36. Here, a distance from the horizontal shaft line 36 to the second wall 54 can be reduced from the second distance D2 as separating from the regulating body 51 toward upstream. In this manner, it is possible to avoid contact between the second wall 54 and the auxiliary housing 35 when the auxiliary housing 35 rotates. In other words, the wall surface of the second wall 54 is provided not to come into contact with the second edge surface 49 when the auxiliary housing 35 rotates. The regulating body 51 is continuous from the first wall 53 to the second wall 54. At this time, the first center angle range θ1 can be set to be greater than 0 (zero) degrees and smaller than 180 degrees. When the first center angle range θ1 and the second center angle range θ2 are adjacent to each other, a sum of the first center angle range θ1 and the second center angle range θ2 is set to be smaller than 180 degrees.

The auxiliary structural body 44 is provided with a first outer wall 55. The first outer wall 55 rises from the outer wall surface 52*a* in the perpendicular direction with respect to the outer wall surface 52*a* of the wall body 52 at a position on the upper surface side of the structural body 28 more than the first wall 53. The first outer wall 55 extends to a rear surface side of the structural body 28 from a downstream end of the first wall 53. The first outer wall 55 intersects at an intersection angle γ1 to be an acute angle on a rear wall surface of the first wall 53. Similarly, the auxiliary structural body 44 is provided with a second outer wall 56. The second outer wall 56 rises from the outer wall surface 52*a* in the perpendicular direction with respect to the outer wall surface 52*a* of the wall body 52 at a position on the lower surface side of the structural body 28 more than the second wall 54. The second outer wall 56 extends to the rear surface side of the structural body 28 from an upstream end of the second wall 54. The second outer wall 56 intersects at an intersection angle γ2 to be an acute angle on a rear wall surface of the second wall 54. Upper ends of the first wall 53, the second wall 54, the regulating body 51, the first outer wall 55, and the second outer wall 56, are mutually combined by one plate piece 57.

The auxiliary regulating section 58 is formed on the upstream end of the second wall 54. As illustrated in FIG. 5, the auxiliary regulating section 58 is disposed on the moving path of the second stopper surface 47. When moving the auxiliary air outlet 42 downward through the rotation of the auxiliary housing 35, the second stopper surface 47 abuts against the auxiliary regulating section 58. In this manner, when moving the auxiliary air outlet 42 downward through the rotation of the auxiliary housing 35, the auxiliary regulating section 58 is positioned on a route of the second stopper surface 47 and regulates the rotation of the auxiliary housing 35. The auxiliary housing 35 can be positioned at a position having 60 degrees of downward blowing range in accordance with the regulation of the rotation. In this position having 60 degrees of downward blowing, the auxiliary air outlet 42 rotates by 60 degrees around the horizontal shaft line 36 downward.

As illustrated in FIG. 6, the structural body 28 is provided with a first side panel 62*a* and a second side panel 62*b* together with main housings 61*a* and 61*b*. The air outlet 31 is formed in the main housing 61*a*. The first side panel 62*a* and the second side panel 62*b* are attached to the main housing 61*a* on both sides of the air outlet 31. The first side panel 62*a* and the second side panel 62*b* constitute an outer shell of the structural body 28. The first side panel 62*a* and the second side panel 62*b* respectively have wall bodies 52. Each of the wall bodies 52 widen in parallel to each other. The outer wall surface 52*a* of the wall body 52 corresponds to the outer wall surface of the structural body 28. Here, the outer wall surface 52*a* may be orthogonal to the horizontal shaft line 36. In this manner, the outer wall surfaces 52*a* widen in parallel to each other. The wall body 52 is fixed to be immovable with respect to the air outlet 31 on both sides of the air outlet 31. The auxiliary structure bodies 44 are respectively integrated with the first side panel 62*a* and the second side panel 62*b*. In the embodiment, the first side panel 62*a* and the auxiliary structural body 44 constitute one member, but these may be configured of separate members. The member can be formed based on integral molding from a hard resin material. Similarly, the second side panel 62*b* and the auxiliary structural body 44 can constitute one member.

When the first side panel 62*a* and the second side panel 62*b* are attached to the structural body 28, a screw 64 is used. The screw 64 penetrates the first side panel 62*a* and the second side panel 62*b*, and is screwed to the main housing 61*a*. When the screw 64 is screwed, a shaft center of the screw 64 is in parallel to the horizontal shaft line 36 and perpendicular to the floor surface when being installed, and is orthogonal to an imaginary plane 65 which is positioned on the front surface side of the first side panel 62*a* and the second side panel 62*b*. Here, the imaginary plane 65 widens in parallel to the horizontal shaft line 36. Moreover, the imaginary plane 65 is oriented to the front surface of the structural body 28. In the frame 61, a screw boss section 66 is regulated so that a screw hole faces the imaginary plane 65. In the first side panel 62*a* and the second side panel 62*b*, screw insertion pieces 67 are respectively provided to overlap with the screw boss section 66. The screw 64 penetrates the screw insertion piece 67 and is screwed to the screw boss section 66.

As illustrated in FIG. 7, each fan unit 26 is provided with the auxiliary housing 35 and an attaching board 68. The auxiliary housing 35 is combined with the attaching board 68. An external appearance of the fan unit 26 is configured of the attaching board 68 and the auxiliary housing 35. Inside the auxiliary housing 35, a blowing path unit 83 and a centrifugal fan 81 are provided. The attaching board 68 overlaps with the outer wall surface 52*a* of the wall body 52. The attaching board 68 is screwed to the wall body 52. A screw 69 penetrates the wall body 52 from the inner wall surface (rear side of the outer wall surface) of the wall body 52, and is screwed to the attaching board 68. Each screw 69 can have a shaft center which is parallel to the horizontal shaft line 36. In this manner, the fan units 26 are respectively fixed to the first side panel 62*a* and the second side panel 62*b*.

The fan unit 26 is provided with a driving source, that is, a motor 71. The motor 71 is fixed to the outer wall surface 52*a* of the wall body 52 on both sides of the air outlet 31 via the attaching board 68. The motor 71 can be configured of an electric motor, for example. The motor 71 is provided with a motor housing 72 which stores a stator and a rotor. A driving shaft 73 protrudes from the motor housing 72. The driving shaft 73 is linked to the rotor. The driving shaft 73 can rotate around a shaft center based on a mutual operation of a magnetic force between the stator and the rotor. The shaft center of the driving shaft 73 intersects the outer wall surface 52*a* of the wall body 52. Here, the shaft center of the driving shaft 73 is orthogonal to the outer wall surface 52*a* of the wall body 52. The shaft center of the driving shaft 73 can overlap with the horizontal shaft line 36.

The fan unit 26 is provided with a control substrate 74. The control substrate 74 is disposed between the outer wall surface 52*a* of the wall body 52 and the motor housing 72. The motor housing 72 is supported by the control substrate 74. A control circuit is constructed on the control substrate 74. The control circuit controls the rotation of the rotor of the motor 71. A female connector 75 is mounted on the control substrate 74. A corresponding male connector can be combined with the female connector 75. Wiring 77 can be connected to the male connector. A control signal can be supplied to the control circuit from the second insulator 77.

The fan unit 26 is provided with a sheet metal member 78. The sheet metal member 78 is disposed between the outer wall surface 52*a* of the wall body 52 and the control substrate 74. The control substrate 74 is supported by the sheet metal member 78. The sheet metal member 78 is fixed to the attaching board 68. The sheet metal 78 can be formed of one sheet metal. The sheet metal can be formed of stainless steel, for example. The sheet metal member 78 widens along a plate surface of the control substrate 74 to be greater than an outline of the control substrate 74. The sheet metal member 78 links the control substrate 74 to the wall body 52.

The fan unit 26 is provided with a protection member 79. The protection member 79 is formed of a flame retardant resin material. The protection member 79 is attached to a blowing path unit 83. The protection member 79 can be formed in a shape of a so-called dome. The protection member 79 partitions a storage space in cooperation with the sheet metal member 78. In the storage space, the motor housing 72, the control substrate 74, and the female connector 75 are stored. The driving shaft 73 of the motor 71 penetrates the protection member 79 and protrudes to the outside of the storage space. A second blower fan, that is, the centrifugal fan 81, is mounted on the driving shaft 73 of the motor 71 on the outer side of the protection member 79. As the centrifugal fan 81, a sirocco fan can be used, for example. The centrifugal fan 81 rotates around the shaft center of the driving shaft 73.

The fan unit 26 is provided with a plurality of rollers 82. Here, the rollers 82 are disposed at an equivalent interval by an interval of 60 degrees from the center angle around the horizontal shaft line 36. The roller 82 has a columnar body. The columnar body is supported by the protection member 79 to be freely rotatable. A shaft center of the columnar body extends in parallel to the horizontal shaft line 36. The roller 82 can rotate around the shaft center of the columnar body. The columnar body can be formed of a resin material, such as a polyacetal resin (POM). The columnar body is in contact with the imaginary cylindrical surface coaxially with the horizontal shaft line 36 on the inner side thereof. A supporting shaft of the roller 82 can be nipped between the protection member 79 and the attaching board 68, for example.

The fan unit 26 is provided with the blowing path unit 83. The blowing path unit 83 is configured of a first member 83*a* and a second member 83*b*. A storage space of the centrifugal fan 81 is partitioned by the blowing path unit 83 and the protection member 79. In this manner, the centrifugal fan 81 is stored in the blowing path unit 83. The first member 83*a* surrounds the periphery of the centrifugal fan 81. The blowing path unit 83 forms an opening 84 which goes through the auxiliary suction port 37, and a blowing path 85 which extends from a lower side of the centrifugal fan 81 to the auxiliary air outlet 42. When the centrifugal fan 81 rotates, the indoor air is taken from the opening 84 along the rotation shaft of the centrifugal fan 81. The centrifugal fan 81 pushes out the indoor air in a centrifugal direction across the entire periphery. The indoor air which is pushed out in this manner is blown out of the auxiliary air outlet 42 across the blowing path 85.

The blowing path 85 is provided so that a range which is below the rotation shaft of the centrifugal fan 81 in the auxiliary air outlet 42 is greater than a range which is above the rotating shaft. As the auxiliary air outlet 42 is open on a side close to the air outlet 31 of the fan unit 26, even when the fan unit 26 is rotated around the horizontal shaft line 36, the auxiliary air outlet 42 is not substantially separated from the air outlet 31.

The blowing path unit 83 is linked to the protection member 79. A cylindrical section 86 is formed in the first member 83*a* of the blowing path unit 83. The cylindrical section 86 forms a cylindrical surface 86*a* coaxially with the horizontal shaft line 36. The plurality of rollers 82 which are provided on the outer peripheral side of the protection member 79 are in contact with the cylindrical surface 86*a* on the inner side thereof. As a result, the cylindrical section 86 can be mounted on the group of the rollers 82. In this manner, the blowing path unit 83 is linked to the protection member 79 to be freely rotatable around the horizontal shaft line 36 via the group of the rollers 82.

The auxiliary housing 35 is configured of a first decorative housing 87*a* and a second decorative housing 87*b*. The first decorative housing 87*a* and the second decorative housing 87*b* are linked to each other to cover the blowing path unit 83. The opening 84 of the blowing path unit 83 overlaps with the auxiliary suction port 37 of the auxiliary housing 35. The blowing path 85 of the blowing path unit 83 is connected to the auxiliary air outlet 42 of the auxiliary housing 35. In this manner, the centrifugal fan 81 or the motor 71 is stored in the auxiliary housing 35. The motor 71, the protection member 79, and the centrifugal fan 81 are attached to the attaching board 68. According to this, the blowing path unit 83 is held to be rotatable around the horizontal shaft line 36 with respect to the protection member 79.

As illustrated in FIG. 8, a rack 88 is formed in the cylindrical section 86 of the blowing path unit 83. The rack 88 is disposed on the cylindrical surface 86*a* at a position which is deviated from the roller 82 in a direction along the horizontal shaft line 36, and extends concentrically to the horizontal shaft line 36. A driving gear 89 meshes with the rack 88. A rotation shaft of the driving gear 89 is set to be parallel to the horizontal shaft line 36. The cylindrical section 86 can rotate with respect to the protection member 79 around the horizontal shaft line 36 in accordance with the rotation of the driving gear 89. In other words, the blowing path unit 83 can rotate.

A driving source, that is, the driving motor 91 is attached to the attaching board 68. A driving shaft of the driving motor 91 is linked to the driving gear 89. A shaft center of the driving shaft overlaps with the rotation shaft of the driving gear 89. In this manner, the rotation of the driving gear 89 is caused based on power of the driving motor 91. The driving motor 91 generates a driving force which causes the rotation of the auxiliary housing 35.

As illustrated in FIG. 9, the fan unit 26 is provided with a driving unit 92 of the wind direction plate 43. The wind direction plate 43 can change a posture around a tangential line (rotation shaft 95) which is on the imaginary plane which is orthogonal to the horizontal shaft line 36 and is in contact with the imaginary circle which is concentric to the horizontal shaft line 36. The driving unit 92 is stored in the auxiliary housing 35, and is fixed to the blowing path unit 83 on the upper side of the blowing path 85. The driving unit 92 is provided with a link member 93. The link member 93 is linked to an upper end of the wind direction plate 43 via an eccentric shaft 96. When the link member 93 is linked to an upper end of the wind direction plate 43, a link case 94 is fixed to the blowing path unit 83. The link case 94 holds the upper end of the wind direction plate 43 to be freely rotatable around the rotation shaft 95 of the wind direction plate 43. The eccentric shaft 96 which is eccentric from the rotation shaft 95 of the wind direction plate 43 and extends in parallel to the rotating shaft 95 of the wind direction plate 43 comes into contact with the upper end of the wind direction plate 43. A guiding path 97 of the eccentric shaft 96 is formed in the link case 94. The guiding path 97 of the eccentric shaft 96 guides movement of the eccentric shaft 96 along an arc which is concentric to the rotation shaft 95 of the wind direction plate 43 when the wind direction plate 43 rotates.

The driving unit 92 is provided with a driving source, that is, a driving motor 98. The driving motor 98 can be fixed to the blowing path unit 83, for example. The driving motor 98 has a driving shaft 98*a* which extends in parallel to the rotation shaft 95 of the wind direction plate 43. An upper end of the driving shaft 98*a* is held by the link case 94 to be freely rotatable. An eccentric shaft 101 which is eccentric from a shaft center 99 of the driving shaft 98*a* and extends in parallel to the shaft center 99 of the driving shaft 98*a* comes into contact with the upper end of the driving shaft 98*a*. A guiding path 102 of the eccentric shaft 101 is formed in the link case 94. The guiding path 102 of the eccentric shaft 101 guides movement of the eccentric shaft 101 along an arc which is concentric to the rotating shaft 99 of the driving shaft 98*a*.

The link member 93 holds the eccentric shafts 96 and 101 to be freely rotatable. When the eccentric shaft 101 moves in the guiding path 102 in accordance with the rotation of the driving motor 98, the movement of the eccentric shaft 101 causes the movement of the link member 93. When the movement is performed, the link member 93 maintains a posture thereof. The movement of the eccentric shaft 101 generates movement of the eccentric shaft 96 along the same path. In this manner, it is possible to change the posture of the wind direction plate 43 synchronously. The driving unit 92 generates a driving force which causes a change in the posture of the wind direction plate 43.

A shielding plate 103 is disposed in the auxiliary air outlet 42 behind the wind direction plate 43. The shielding plate 103 widens in the direction of gravity from an outer edge 104 of a flowing-out end of the blowing path 85. The shielding plate 103 blocks all parts except for the flowing end of the blowing path 85 in the auxiliary air outlet 42.

As illustrated in FIG. 10, the first blower fan 27 is supported to be freely rotatable by the main structural body 28. As the first blower fan 27, a cross flow fan can be used, for example. The first blower fan 27 can rotate around a rotation shaft 105 in parallel to the horizontal shaft line 36. The rotation shaft 105 of the first blower fan 27 extends in the horizontal direction when being installed. In this manner, the first blower fan 27 is disposed in parallel to the air outlet 31. The indoor heat exchanger 14 is disposed on the periphery of the first blower fan 27.

A driving source 106 is fixed to the main structural body 28. As the driving source 106, an electric motor can be used, for example. The driving shaft of the driving source 106 rotates around the shaft center thereof. The driving shaft can be disposed coaxially to the rotation shaft 105 of the first blower fan 27. The driving shaft of the driving source 106 can be combined with the rotation shaft of the first blower fan 27. In this manner, the driving force of the driving source 106 is transferred to the first blower fan 27. The driving source 106 drives the first blower fan 27. The airflow passes through the indoor heat exchanger 14 in accordance with the rotation of the first blower fan 27. As a result, the cool or warm airflow is generated. The cool or warm airflow is blown out of the air outlet 31.

A distance L1 is set between an imaginary shaft line which includes a rotation shaft of the auxiliary housing 35, that is, the horizontal shaft line 36, and the auxiliary air outlet 42. A distance L2 is set between the horizontal shaft line 36 and the front surface of the main structural body 28. Here, the distance L1 is set to be longer than the distance L2. As a result, when the auxiliary housing 35 rotates and the auxiliary air outlets 42 are disposed on both sides of the front surface of the main structural body 28, the auxiliary air outlets 42 are disposed in front of the front surface of the main structural body 28.

The distance L1 may be set to be shorter than the distance L2. In this case, when the auxiliary housing 35 rotates and the auxiliary air outlets 42 are disposed on both sides of the front surface of the main structural body 28, the auxiliary air outlets 42 are disposed behind the front surface of the main structural body 28. For this reason, even in a case where the indoor unit is placed while the front surface side of the main structural body is oriented toward the floor surface when a positioning operation of the indoor unit is performed, the auxiliary air outlet 42 is not in contact with the floor surface. Since a load is not applied to the auxiliary air outlet 42, there is no concern that the auxiliary housing 35 is damaged.

In addition, the distance L1 from the horizontal shaft line 36 and the auxiliary air outlet 42 is set to be longer than the distance L3 from the horizontal shaft line 36 to the air outlet 31 (specifically, a surface which links a tip end section 31*a* of a rear side blowing path 31*b* and a tip end section 31*d* of the front side blowing path 31*c*). At this time, the upper and lower wind direction plates 32*a* and 32*b* may establish a posture of blowing out the cool or warm airflow in the horizontal direction. As illustrated in FIG. 11, when the auxiliary housing 35 rotates and the auxiliary air outlets 42 are disposed on both sides of a downward-facing surface of the main structural body 28, the auxiliary air outlet 42 is positioned below the air outlet 31. Air-blowing from the auxiliary air outlet 42 is blown out without being disturbed by the main structural body 28.

Next, operations of the air conditioner 11 will be described. For example, when the cooling operation is set, the four-way valve 18 connects the second port 18*b* and the third port 18*c* to each other, and connects the first port 18*a* and the fourth port 18*d* to each other. The refrigerant circulates in the refrigerant circuit 19 in accordance with the operation of the compressor 15. As a result, cool air is generated by the indoor heat exchanger 14. The temperature of the cool air is lower than at least the temperature of the indoor air. The operation of the compressor 15 is controlled in accordance with the room temperature which is detected by a room temperature sensor. In addition, for example, when a human sensor detects that the human being in the room is not present for a predetermined period, the compressor 15 may stop.

When the first blower fan 27 rotates, for example, as illustrated in FIG. 12, a cool airflow 107 is blown out of the air outlet 31. At this time, the posture of the upper and lower wind direction plates 32*a* and 32*b* is appropriately controlled. The airflow 107 can be controlled to be blown out in accordance with the orientation of the upper and lower wind direction plates 32*a* and 32*b*. Here, by making the upper and lower wind direction plates 32*a* and 32*b* substantially parallel to the floor surface, the cool airflow 107 is blown out of the air outlet 31 in the horizontal direction.

When the second blower fan 81 rotates, the indoor air is sucked from the auxiliary suction port 37 into a space in the auxiliary housing 35 by the fan unit 26. The temperature of the indoor air is equivalent to the room temperature. The airflow of the sucked-in indoor air is blown out of the auxiliary air outlet 42 of the fan unit 26. At this time, the posture of the auxiliary housing 35 is appropriately controlled around the horizontal shaft line 36. For example, as illustrated in FIG. 12, a posture of the auxiliary housing 35 can be changed downward from the horizontal posture. The auxiliary housing 35 can induce an airflow 108 to be blown out of the auxiliary air outlet 42 downward from the horizontal direction. The airflow 108 of the indoor air is blown out of the auxiliary air outlet 42 downward.

In general, the indoor unit 12 is installed at a comparatively high position in the room. If the cool airflow 107 is induced in the horizontal direction, the cool air descends toward the floor surface from a high position. In the room, the cool air gradually accumulates. At this time, the fan unit 26 can make the airflow 108 of the indoor air directly oriented towards a human being in the room M. The fan unit 26 can function as a substitute of a so-called electric fan when the cooling operation is operated. It is possible to prevent the cool air from being mixed in the airflow 108 of the indoor air. As a result, the human being in the room M can obtain a pleasant cool feeling. In addition to the cool feeling based on a decrease in the indoor temperature, the human being in the room M can obtain a cool feeling based on the heat of vaporization which is generated by the airflow 108. Here, the auxiliary air outlet 42 is disposed below the upper and lower wind direction plates 32*a* and 32*b*. Therefore, it is possible to avoid collision between the airflow 108 from the auxiliary air outlet 42 and the cool airflow 107. It is possible to excellently maintain a force of the airflow.

For example, as illustrated in FIG. 13, it is possible to establish the posture of the auxiliary housing 35 to be a horizontal posture when the cooling operation is performed. The airflow 108 of the indoor air is blown out of the auxiliary air outlet 42 in the horizontal direction. Here, when a wind speed of the airflow 108 of the auxiliary air outlet 42 is higher than a wind speed of the airflow 107 of the air outlet 31, the airflow 108 having a higher wind speed can control the airflow 107 having a lower wind speed. The airflow 108 of the indoor air can control an orientation or movement of the cool airflow 107. The cool air can be sent to a desired indoor location. Here, the airflow 108 of the auxiliary air outlet 42 can be gently blown downward towards the floor surface across a ceiling and a wall together with the cool airflow 107. In the room, it is possible to generate a gentle flow of the air along the floor surface. The human being in the room M can obtain a natural pleasant cool feeling in accordance with a breeze of convection. Since the auxiliary air outlet 42 is positioned in front of the main structural body 28, the airflow 108 of the indoor air can be blown out of the auxiliary air outlet 42 without collision with the main structural body 28. It is possible to excellently maintain a force of the airflow.

For example, when the heating operation is set, the four-way valve 18 connects the second port 18*b* and the fourth port 18*d* to each other, and connects the first port 18*a* and the third port 18*c* to each other. The refrigerant circulates in the refrigerant circuit 19 in accordance with the operation of the compressor 15. As a result, warm air is generated by the indoor heat exchanger 14. The temperature of the warm air is higher than at least the temperature of the indoor air. The operation of the compressor 15 is controlled in accordance with the room temperature which is detected by a room temperature sensor. For example, when the human sensor detects that the human being in the room is not present for a predetermined period, the compressor 15 may stop.

As illustrated in FIG. 14, in the heating operation, the warm airflow 107 is blown out of the air outlet 31 in accordance with the rotation of the first blower fan 27. At this time, the posture of the upper and lower wind direction plates 32*a* and 32*b* can be established downward. The upper and lower wind direction plates 32*a* and 32*b* induce the airflow 107 to be blown out of the air outlet 31 toward the floor surface downward. The warm airflow 107 is blown out of the air outlet 31 downward.

Here, the posture of the auxiliary housing 35 is held to be a horizontal posture. The auxiliary housing 35 induces the airflow 108 to be blown out of the auxiliary air outlet 42 in the horizontal direction. The airflow 108 of the indoor air is blown out of the auxiliary air outlet 42 in the horizontal direction. For example, until the room temperature reaches a certain temperature which is lower than a set temperature, it is possible to maintain air-blowing from the fan unit 26 in the horizontal direction. The room temperature can be detected by a room temperature sensor.

If the warm airflow 107 is induced downward, the warm air can be blown out toward the floor surface. When the indoor temperature is low, for example, as illustrated in FIG. 14, the warm air is likely to immediately ascend toward the ceiling from the floor surface. At this time, the fan unit 26 can generate the flow of the air in the room while winding the ascending warm air. The warm air can descend toward the floor surface again along the flow of the air. In this manner, the warm air is sufficiently sent to the lower part of the room. Without warming the entire room, a heating effect can be obtained.

In the air conditioner 11, the cool or warm airflow 107 is blown out of the air outlet 31 of the electrolyte solution 25. The airflow 108 of the indoor air is blown out of the auxiliary air outlet 42 of the fan unit 26. The airflow 108 of the indoor air can control the orientation or movement of the cool or warm airflow 107. The cool air or the warm air can be sent to a desired indoor location. In this manner, it is possible to efficiently regulate the indoor temperature environment. At this time, the auxiliary air outlet 42 of the fan unit 26 can relatively move with respect to the airflow which is blown out of the air outlet 31 of the main body unit 25. Therefore, the airflow 108 of the indoor air can be set to have a desired orientation. According to such an orientation setting, the orientation or the movement of the cool or warm airflow 107 can be accurately controlled.

For example, when the wind speed of the airflow 108 of the auxiliary air outlet 42 is higher than the wind speed of the airflow 107 of the air outlet 31, the airflow 108 having a higher wind speed can control the airflow 107 having a lower wind speed. The airflow 108 of the indoor air can control an orientation or movement of the cool airflow 107. The cool air can be sent to a desired indoor location. For example, when the cooling operation is performed, when the horizontal posture of the auxiliary housing 35 is established, the airflow 108 of the auxiliary air outlet 42 can be gently blown down toward the floor surface across the ceiling and the wall together with the cool airflow 107. In the room, it is possible to generate a gentle flow of the air along the floor surface. The human being in the room M can obtain a natural pleasant cool feeling in accordance with a breeze of convection.

As described above, the rotating shaft of the centrifugal fan 81 overlaps with the rotation shaft of the auxiliary housing 35 in the indoor unit 12. Therefore, it is possible to constantly maintain a relative positional relationship between a moving trajectory of blades of the centrifugal fan 81 and the auxiliary housing 35. Even when the auxiliary housing 35 rotates, it is possible to always generate a constant airflow.

In order to blow the airflow which is generated by a blower, it is required that a blowing path having a predetermined length is formed. According to the blowing path 85 described above, even when the outline of the auxiliary housing 35 does not protrude from the outline of the structural body 28, the blowing path 85 and the auxiliary air outlet 42 can be easily disposed on both sides of the air outlet 31. Moreover, without damaging a design of the indoor unit 12, it is possible to sufficiently ensure a length of the blowing path 85. As a result, the centrifugal fan 81 can be sufficiently far from the auxiliary air outlet 42. Since the length of the blowing path 85 is ensured, it is easy to satisfy the insertion of a standard finger.

REFERENCE SIGNS LIST

12: Air conditioner (indoor unit), 14: Heat exchanger (indoor heat exchanger), 27: First blower fan, 28: Structural body, 31: Air outlet, 32*a*: Wind direction plate (upper and lower wind direction plate), 32*b*: Wind direction plate (upper and lower wind direction plate), 33*a*: Horizontal shaft line, 33*b*: Horizontal shaft line, 35: Auxiliary housing, 36: Horizontal shaft (horizontal shaft line), 42: Auxiliary air outlet, 52: Wall body, 52*a*: Outer wall surface, 53: Wall (first wall), 54: Wall (second wall), 55: First outer wall, 56: Second outer wall, 57: First plate piece and second plate piece (plate piece), 71: Second driving source (motor), 81: Second blower fan (centrifugal fan), 85: Blowing path, 106: First driving source (driving source)

The invention claimed is:

1. An air conditioner, comprising: a structural body having a front surface and a downward-facing surface which is continuous downward from the front surface, the structural body forming an air outlet in the downward-facing surface, wherein the air outlet extends in a horizontal direction and blows out a cool or warm airflow which is generated by a heat exchanger, the structural body including one pair of wall bodies which are fixed to both sides of the air outlet; a wind direction plate which is disposed in the air outlet and is supported by the structural body for relative rotation around a first horizontal axis of pivot; and auxiliary housings which are attached to an outer wall surface of the wall body for relative rotation around a second horizontal axis of pivot on both sides of the air outlet, each of the auxiliary housings forming an auxiliary air outlet which blows out a room temperature air separate from the cool or warm airflow, wherein a distance LI from an imaginary axis including the second horizontal axis of pivot to the auxiliary air outlet is set to be longer than a distance L3 from the imaginary axis to the air outlet of the structural body, a first driving source which drives a first blower fan that is installed in the structural body and generates the cool or warm airflow; and a second driving source which drives a second blower fan that is installed in the auxiliary housing and generates the airflow of the room temperature air, wherein the second blower fan is a centrifugal fan which rotates around a rotation axis which coincides with the imaginary axis, and generates an airflow which is blown out of the auxiliary air outlet.

2. The air conditioner according to claim 1, further comprising:

a blowing path which is defined in the auxiliary housing, and extends from a space below the centrifugal fan to the auxiliary air outlet.

3. The air conditioner according to claim 1, wherein a distance L2 from the imaginary axis to the front surface of the structural body is set to be longer than the distance L3, and L1>L2.

4. The air conditioner according to claim 2, wherein a distance L2 from the imaginary axis to the front surface of the structural body is set to be longer than the distance L3, and L1>L2.

* * * * *